US009605462B2

(12) United States Patent
Bacchetti

(10) Patent No.: US 9,605,462 B2
(45) Date of Patent: Mar. 28, 2017

(54) HINGE DEVICE FOR DOORS, SHUTTERS AND THE LIKE

(71) Applicant: IN & TEC S.R.L., Brescia (IT)

(72) Inventor: Luciano Bacchetti, Nave (IT)

(73) Assignee: IN & TEC S.R.L., Brescia (IT)

( * ) Notice: Subject to any disclaimer, the term of this patent is extended or adjusted under 35 U.S.C. 154(b) by 67 days.

(21) Appl. No.: 14/430,218

(22) PCT Filed: Oct. 4, 2013

(86) PCT No.: PCT/IB2013/059120

§ 371 (c)(1),
(2) Date: Mar. 21, 2015

(87) PCT Pub. No.: WO2014/054028

PCT Pub. Date: Apr. 10, 2014

(65) Prior Publication Data

US 2015/0233164 A1 Aug. 20, 2015

(30) Foreign Application Priority Data

Oct. 4, 2012 (IT) ..... VI2012A0254
Oct. 4, 2012 (IT) ..... VI2012A0255

(51) Int. Cl.
*E05F 3/20* (2006.01)

(52) U.S. Cl.
CPC ..... *E05F 3/20* (2013.01); *Y10T 16/2771* (2015.01)

(58) Field of Classification Search
CPC ..... E05F 3/20; Y10T 16/2771
See application file for complete search history.

(56) References Cited

U.S. PATENT DOCUMENTS 424,613 A * 4/1890 Morris ..... E05F 3/20 16/49
424,614 A * 4/1890 Morris ..... E05F 3/20 16/49
491,898 A * 2/1893 Lowe ..... E05F 3/20 16/49
1,134,510 A * 4/1915 Busch ..... E05F 3/20 16/49

(Continued)

FOREIGN PATENT DOCUMENTS

KR 20060021588 A 3/2006
KR 20070043283 A 4/2007

(Continued)

*Primary Examiner* — Jeffrey O Brien
(74) *Attorney, Agent, or Firm* — Themis Law

(57) ABSTRACT

A hinge device includes a first fixed tubular half-shell having a working chamber defining a longitudinal axis, a second tubular half-shell rotatable about the longitudinal axis, a pivot rotating unitarily with the latter which includes a single pass-through actuating member having a helical shape, a plunger member slidable along the longitudinal axis, and a tubular bushing having a pair of guide cam slots. A pin inserted within the pass-through actuating member is provided to allow the mutual engagement of the pivot and the bushing. The first tubular half-shell includes an end portion susceptible to rotatably support the pivot, the second tubular half-shell and the bushing are coaxially coupled to each other, and the bushing and the first tubular half-shell are mutually unitarily coupled.

15 Claims, 30 Drawing Sheets

(56) References Cited

U.S. PATENT DOCUMENTS 1,139,822 A * 5/1915 Sundh ..... E05F 3/20 16/317
1,200,538 A * 10/1916 Smith et al. ..... E05D 11/1078 16/303
1,241,083 A * 9/1917 Bommer ..... E05F 3/20 16/54
1,423,784 A * 7/1922 Vuille ..... E05F 3/20 16/55
2,015,988 A * 10/1935 Bommer ..... E05F 3/10 16/54
2,018,564 A * 10/1935 Milly ..... E05F 16/374
2,027,170 A * 1/1936 Hemingway ..... E05F 3/08 16/53
2,103,660 A * 12/1937 Bommer ..... E05F 3/10 16/54
2,118,950 A * 5/1938 Stannard ..... E05F 3/20 16/256
2,127,327 A * 8/1938 De Millar ..... E05F 3/08 16/54
5,222,277 A * 6/1993 Harvey ..... B64G 1/22 16/48.5
5,572,768 A * 11/1996 Daul ..... E05F 1/1215 16/337
6,928,699 B2 * 8/2005 Sawa ..... E05F 3/20 16/303
7,155,776 B2 * 1/2007 Park ..... E05F 3/20 16/312
7,243,394 B2 * 7/2007 Kao ..... E05F 3/20 16/284
7,305,797 B2 * 12/2007 Chiang ..... E05D 5/0246 16/252
8,387,210 B2 * 3/2013 Sawa ..... E05F 1/1223 16/310
8,510,911 B2 * 8/2013 Sawa ..... E05F 1/1223 16/310
2004/0034964 A1 * 2/2004 Loggen ..... E05D 5/0246 16/49
2004/0206007 A1 * 10/2004 Chiang ..... E05D 5/0246 49/388
2004/0250377 A1 * 12/2004 Park ..... E05F 3/20 16/50
2005/0246863 A1 * 11/2005 Chesworth ..... E05F 1/063 16/221
2009/0241289 A1 * 10/2009 Choi ..... E05F 3/20 16/275
2011/0041285 A1 * 2/2011 Hong ..... E05F 1/1215 16/54

FOREIGN PATENT DOCUMENTS

WO WO0061903 A1 10/2000
WO WO0166894 A1 9/2001
WO WO03067011 A1 8/2003
WO WO2006025663 A1 3/2006

* cited by examiner 112
13
17
13'
53
X
15
82
12
81
73
14
50
73
72
110
41
30
53
60
80
13
50
60

HINGE DEVICE FOR DOORS, SHUTTERS AND THE LIKE

FIELD OF INVENTION

The present invention is generally applicable to the technical field of the closing and/or control hinges for doors, shutters or like closing elements, and particularly relates to a hinge device for rotatably moving and/or controlling during closing and/or opening a closing element, such as a door, a shutter or the like, anchored to a stationary support structure, such as a wall or a frame.

BACKGROUND OF THE INVENTION

As known, hinges generally include a movable member, usually fixed to a door, a shutter or the like, pivoted onto a fixed member, usually fixed to the support frame thereof, or to a wall and/or to the floor.

From documents U.S. Pat. No. 7,305,797, EP1997994 and US2004/206007 hinges are known wherein the action of the closing means that ensure the return of the door in the closed position is not damped. From document EP0407150 is known a door closer which includes hydraulic damping means for damping the action of the closing means.

All these known devices are more or less bulky, and consequently they have an unpleasant aesthetic appeal. Moreover, they do not allow for adjustment of the closing speed and/or of the latch action of the door, or in any case they do not allow a simple and quick adjustment.

Further, these known devices have a large number of construction parts, being both difficult to manufacture and relatively expensive, and requiring frequent maintenance.

Other hinges are known from documents GB19477, U.S. Pat. No. 1,423,784, GB401858, WO03/067011, US2009/241289, EP0255781, WO2008/50989, EP2241708, CN101705775, GB1516622, US20110041285, WO200713776, WO200636044, US20040250377 and WO2006025663.

These known hinges can be improved in terms of size and/or reliability and/or performance.

SUMMARY OF THE INVENTION

An object of the present invention is to overcome at least partly the above mentioned drawbacks, by providing a hinge device having high functionality, simple construction and low cost.

Another object of the invention is to provide a hinge device that allows a simple and quick adjustment of the opening and/or closing angle of the closing element to which it is coupled.

Another object of the invention is to provide a hinge device of small bulkiness that allows automatically closing even very heavy doors.

Another object of the invention is to provide a hinge device which ensures the controlled movement of the door to which it is coupled, during opening and/or during closing.

Another object of the invention is to provide a hinge device which has a minimum number of constituent parts.

Another object of the invention is to provide a hinge device capable of maintaining time the exact closing position over time.

Another object of the invention is to provide a hinge device extremely safe.

Another object of the invention is to provide a hinge device extremely easy to install.

These objects, as well as others that will appear more clearly hereinafter, are achieved by a hinge device having one or more of the features herein disclosed and/or claimed and/or shown.

Advantageous embodiments of the invention are defined in accordance with the dependent claims.

BRIEF DESCRIPTION OF THE DRAWINGS

Further features and advantages of the invention will appear more evident upon reading the detailed description of some preferred, non-exclusive embodiments of a hinge device according to the invention, which are described as non-limiting examples with the help of the annexed drawings, wherein.

DETAILED DESCRIPTION OF SOME PREFERRED EMBODIMENTS

With reference to the above figures, the hinge device according to the invention, generally indicated with 1, is particularly useful for rotatably moving and/or controlling a closing element D, such as a door, a shutter, a gate or the like, which can be anchored to a stationary support structure S, such as a wall and/or a door or window frame and/or a support pillar and/or the floor.

Depending on the configuration, the hinge device 1 according to the invention allows only the automatic closing of the closing element D to which it is coupled, as shown in FIGS. 30 to 34*c*, or only the control during opening and/or closing thereof, as shown for example in FIGS. 22 to 25*b*, or both actions, as shown in FIGS. 1 to 5*c*.

In general, the hinge device 1 may include a fixed element 10 anchored to the stationary support structure S and a movable element 11 which may be anchored to the closing element D.

In a preferred, not exclusive embodiment, the fixed element 10 may be positioned below the movable element 11.

Figure 1:
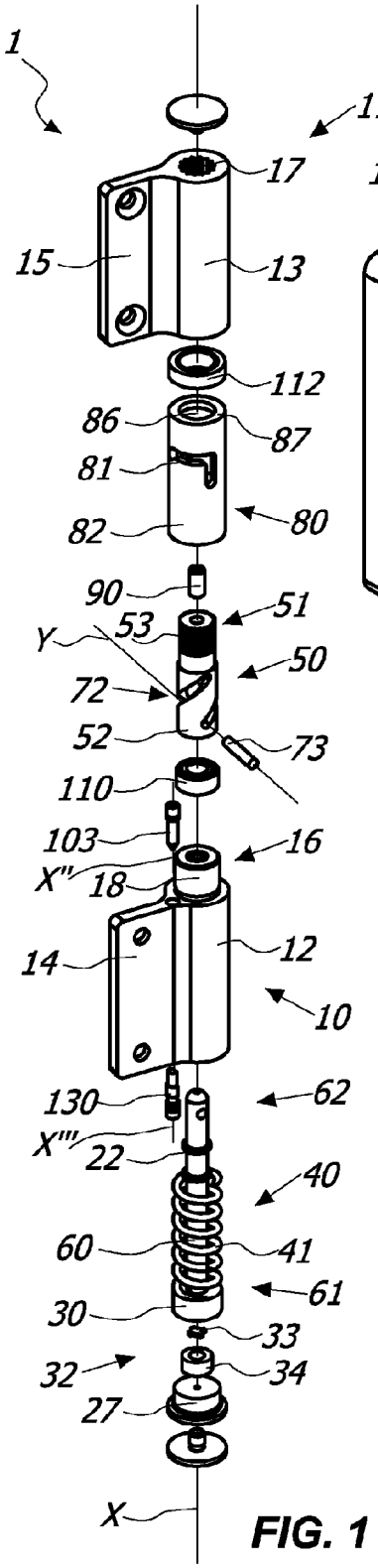
FIG. 1 is an exploded view of a first embodiment of the hinge device 1.
Figure 2A:
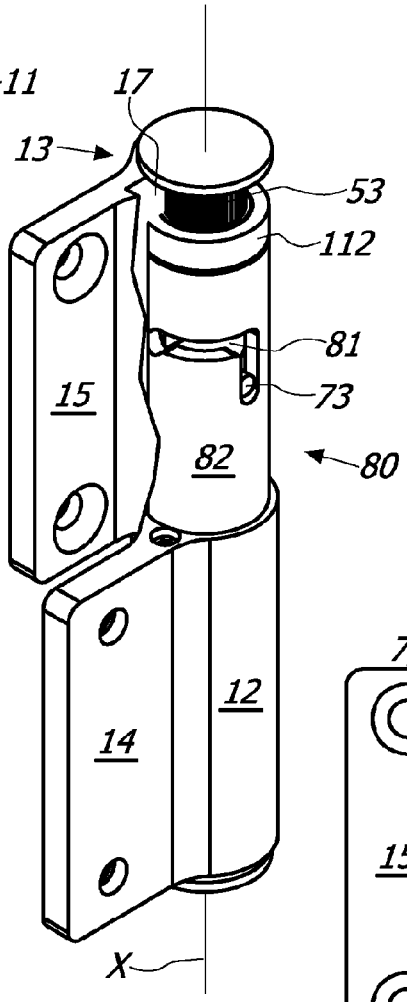
FIGS. 2*a* and 2*b* are respectively axonometric and axially sectioned views of the first embodiment of the hinge device 1 of FIG. 1, wherein the second tubular half-shell 13 is in the closed position.
Figure 2B:
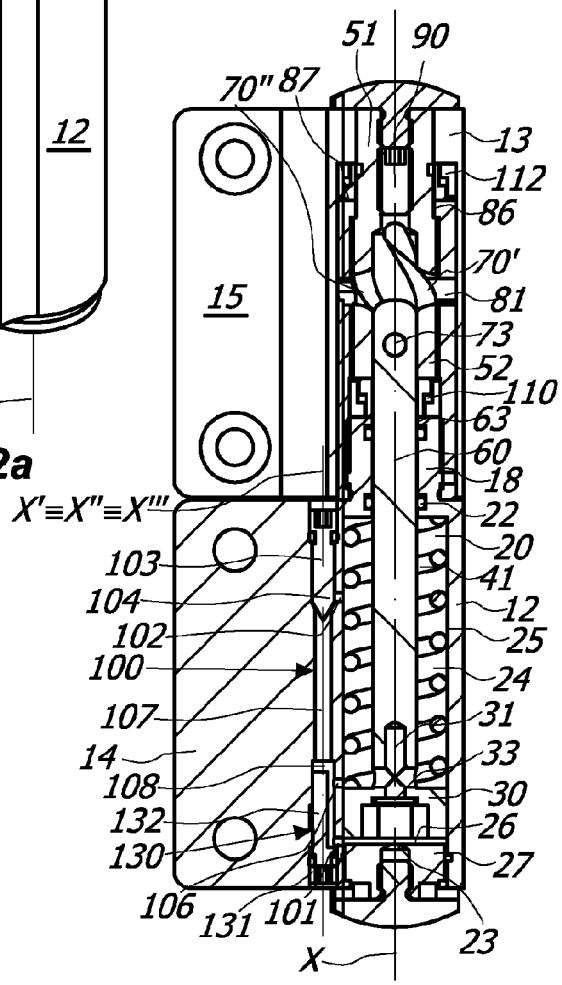

In a preferred, not exclusive embodiment, the fixed and movable elements 10, 11 may include a respective first and second tubular half-shell 12, 13 mutually coupled each other to rotate about a longitudinal axis X between an open position, shown for example in FIGS. 3*a* to 5*c*, and a closed position, shown for example in FIGS. 2*a* and 2*b*.

Suitably, the fixed and movable elements 10, 11 may include a respective first and second connecting plates 14, 15 connected respectively to the first and second tubular half-shell 12, 13 for anchoring to the stationary support structure S and the closing element D.

Preferably, the hinge device 1 can be configured as an "anuba"-type hinge.

Advantageously, with the exception of connecting plates 14, 15, all other components of the hinge device 1 may be included within the first and second tubular half-shells 12, 13.

In particular, the first tubular half-shell 12 may be fixed and include a working chamber 20 defining the axis X and a plunger member 30 sliding therein. Appropriately, the working chamber 20 can be closed by a closing cap 27 inserted into the tubular half-shell 12.

As better explained later, the first fixed tubular half-shell 12 may further include a working fluid, usually oil, acting on the piston 30 to hydraulically counteract the action thereof and/or elastic counteracting means 40, for example a helical compression spring 41, acting on the same plunger member 30.

Suitably, externally to the working chamber 20 and coaxially therewith a pivot 50 may be provided, which may advantageously act as an actuator, which may include an end portion 51 and a tubular body 52. Advantageously, the pivot 50 may be supported by the end portion 16 of the first fixed tubular half-shell 12.

The end portion 51 of the pivot 50 will allow the coaxial coupling between the same and the second movable tubular half-shell 13, so that the latter and the pivot 50 unitary rotate between the open and the closed positions of the second movable tubular half-shell 13.

To this end, in a preferred, not exclusive embodiment, the end portion 51 of the pivot 50 may include an outer surface 53 having a predetermined shape which is coupled, preferably in a removable manner, with a countershaped surface 17 of the second movable tubular half-shell 13.

Figures 6A, 6B, 6C, 7:
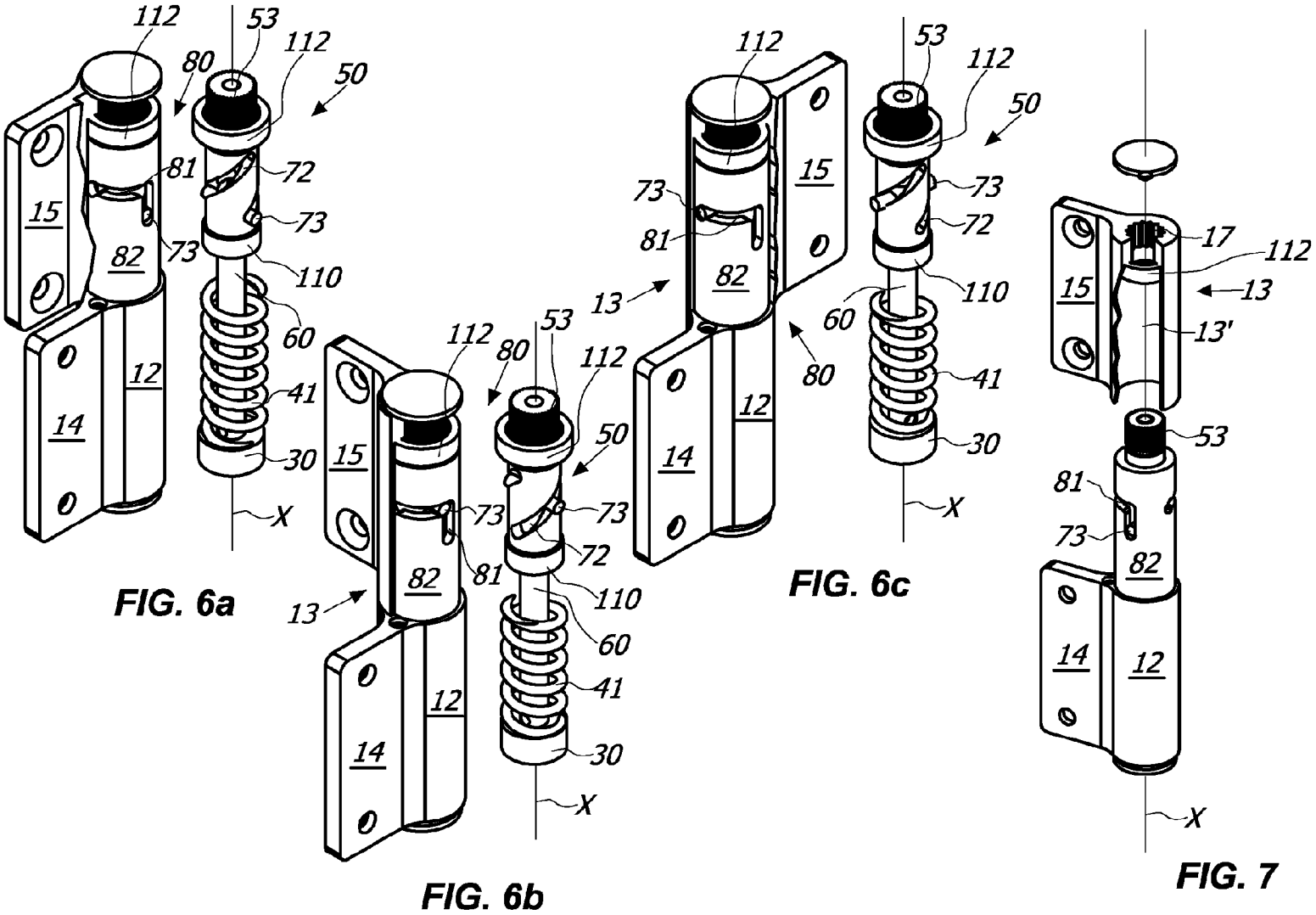
FIGS. 6*a*, 6*b* and 6*c* are axonometric views of the hinge device 1 of FIG. 1 which show the position of the pin 73 relative to both the bushing 80 and the pivot 50 respectively in the closed positions of FIGS. 3*a* and 3*b*, in the partially open position of FIGS. 4*a* and 4*b* and in the of fully open position of FIGS. 5*a*, 5*b* and 5*c;*
FIG. 7 is a partially exploded, broken axonometric view of the hinge device 1 of FIG. 1, which shows the coupling between the second movable tubular half-shell 13 and the bushing 80.

In a preferred, not exclusive embodiment, shown for example in FIG. 7, the shaped surface 53 may include a plurality of axial projections, susceptible to engage corresponding recesses of the countershaped surface 17.

Preferably, the shaped surface 53 of the pivot 50 and the countershaped surface 17 of the second tubular half-shell 13 may be configured so as to allow the selective variation of the mutual angular position thereof.

Figure 38A:
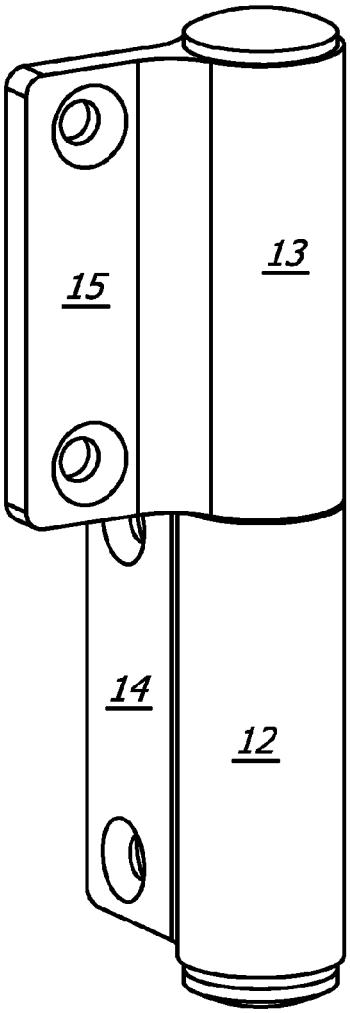
FIGS. 38*a* and 38*b* are axonometric views of the hinge device 1 of FIG. 36, which respectively show the relative position of the connecting plates 14, 15 and the positions of the pin 73, the plunger member 30 and the elastic counteracting means 40 in the position shown in FIG. 37.
Figure 38B:
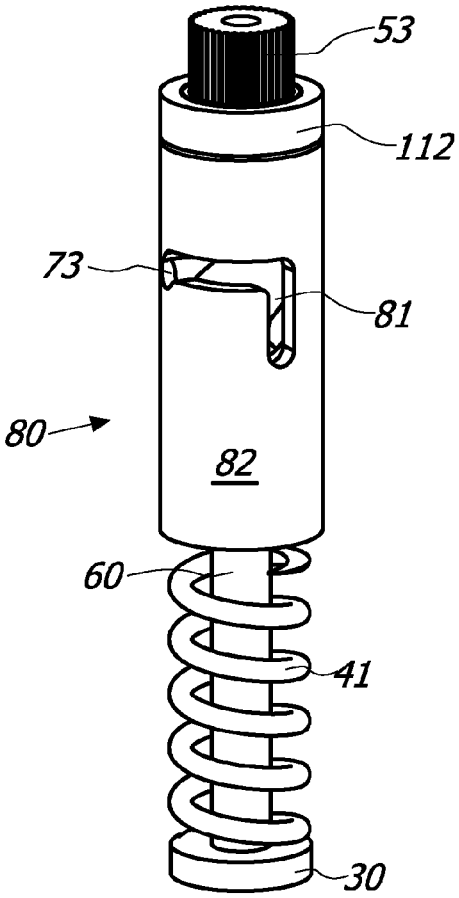
Figure 39:
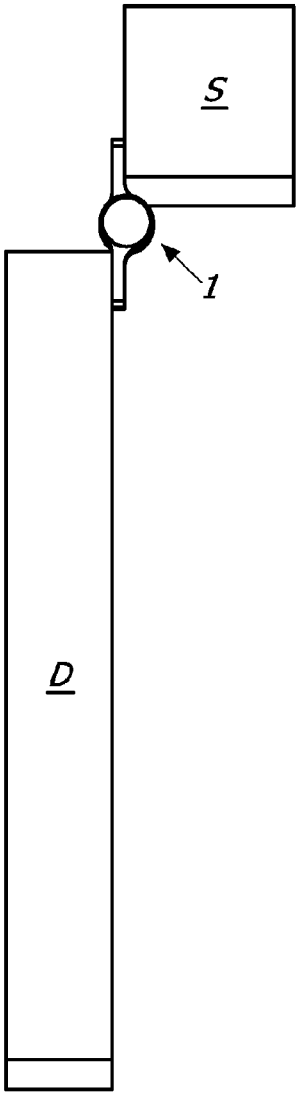
FIG. 39 is a top view of the embodiment of FIG. 35 wherein the hinge device 1 has the second tubular half-shell 13 in a partially open position.
Figure 40A:
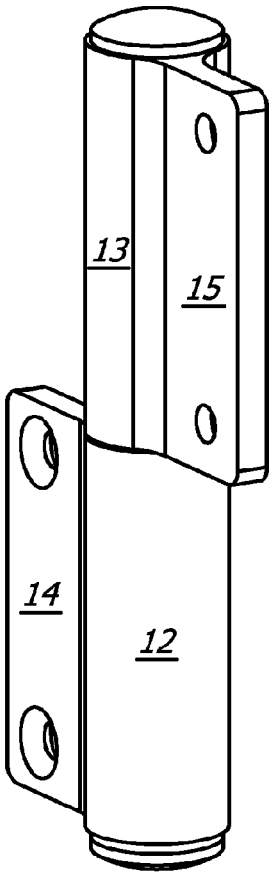
FIGS. 40*a* and 40*b* are axonometric views of the hinge device 1 of FIG. 36, which respectively show the relative position of the connecting plates 14, 15 and the positions of the pin 73, the plunger member 30 and the elastic counteracting means 40 in the position shown in FIG. 39.
Figure 40B:
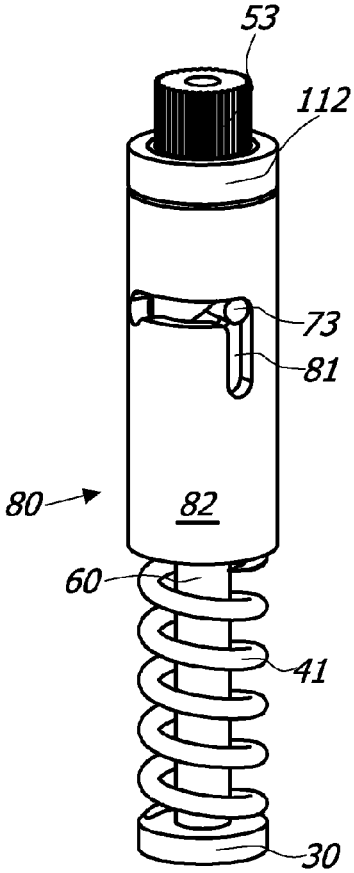
Figure 41:
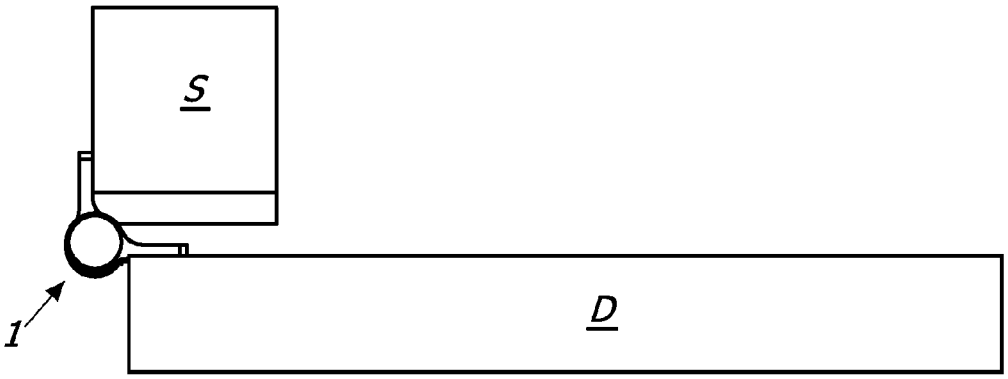
FIG. 41 is a top view of the embodiment of FIG. 35 wherein the hinge device 1 has the second tubular half-shell 13 is in the fully open position.
Figure 42A:
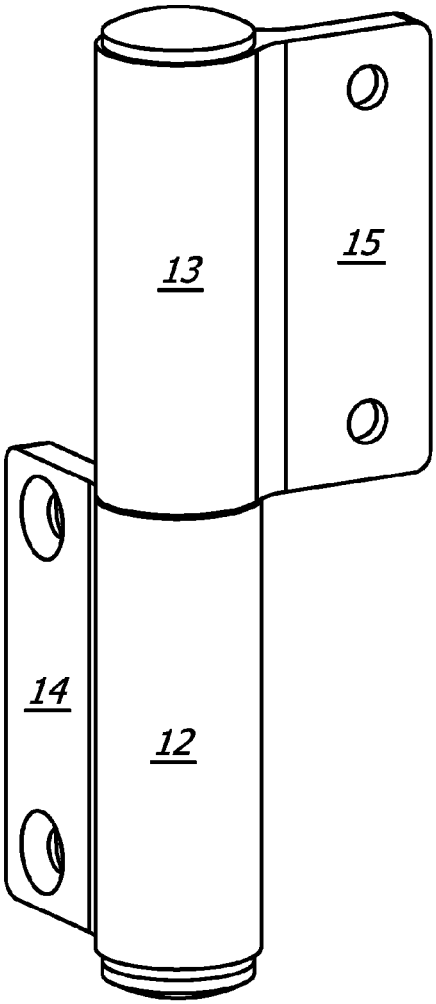
FIGS. 42*a* and 42*b* are axonometric views of the hinge device 1 of FIG. 36, which respectively show the relative position of the connecting plates 14, 15 and the positions of the pin 73, the plunger member 30 and the elastic counteracting means 40 in the position shown in FIG. 41.
Figure 42B:
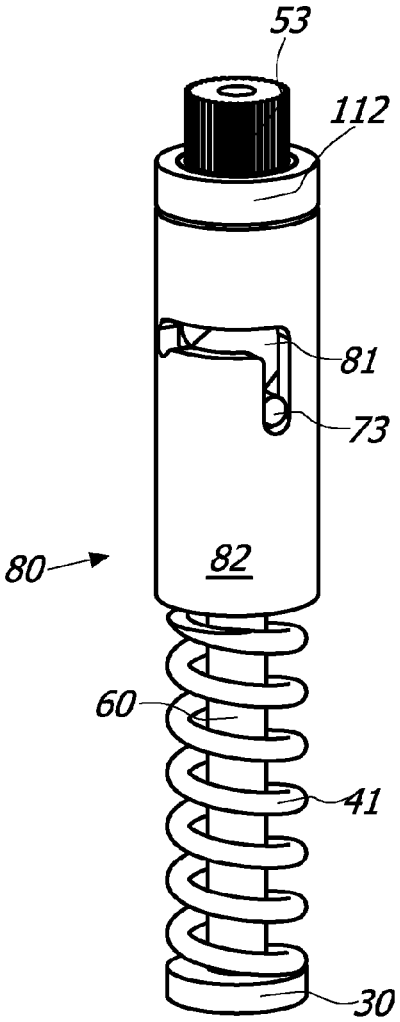
Figure 43A:
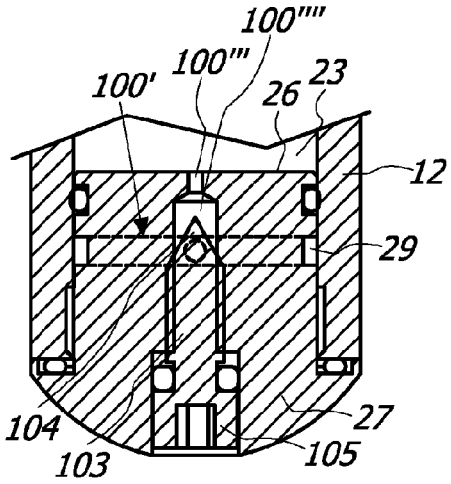
FIGS. 43*a* and 43*b* are enlarged sectional views of some details of the embodiment of the hinge device 1 of FIG. 20.
Figure 43B:
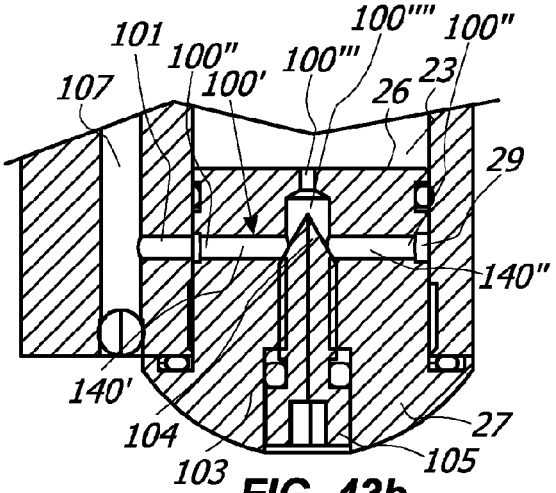
Figure 44A:
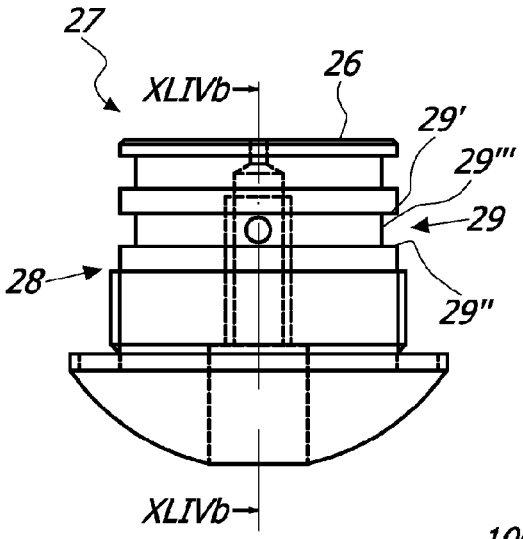
FIGS. 44*a*, 44*b* and 44*c* are side, sectioned along a plane XLIV-XLIV and axonometric sectioned as above views of the end cap 27.
Figure 44B:
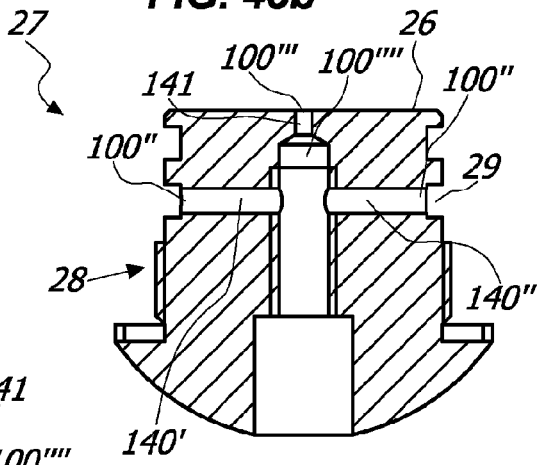
Figure 44C:
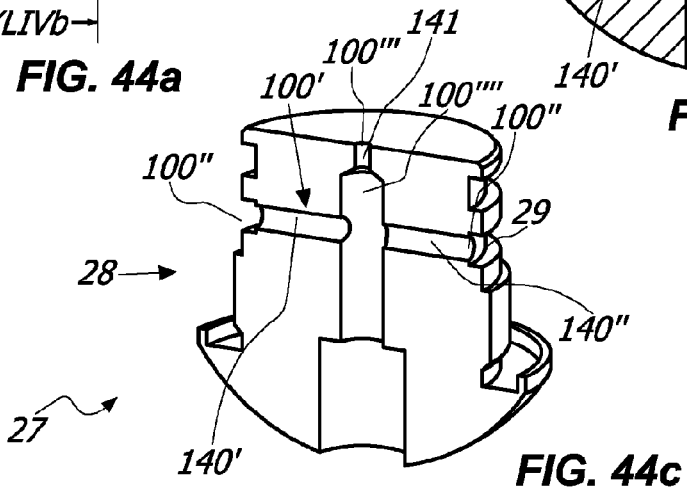

In this way, it will be possible to change the mutual angular position of the connecting plates 14, 15 according to needs in such a manner that, for example, they may be perpendicular to each other in the closed position of the closing element D, as shown e.g. in FIG. 38.

Suitably, the plunger member 30 and the pivot 50 may be operatively connected to each other through the elongated cylindrical element 60, so that the rotation of the latter about the axis X corresponds to the sliding of the former along the same axis X and vice-versa.

To this end, the elongate element 60 may include a first cylindrical end portion 61 inserted within the working chamber 20 and mutually connected with the plunger member 30 and a second end portion 62 external to the working chamber 20 and sliding within the tubular body 52 of the pivot 50.

The connection between the elongate cylindrical element 60 and the plunger member 30 may be susceptible to make unitary these elements, so that they may define a slider movable along the axis X.

Advantageously, the tubular portion 52 of the pivot 50 may have an internal diameter Di' substantially coincident with the diameter D''' of the elongated cylindrical element 60.

The elongated cylindrical element 60 may therefore be slidable along the axis X unitary with the plunger member 30. In other words, the elongated cylindrical element 60 and the pivot 50 may be coupled together in a telescopic manner.

Moreover, as better explained later, depending on the configuration of the guide cam slots 81 of the bushing 80 the cylindrical elongated element 60 with its plunger member 30 may or may not be rotatably locked in the working chamber 20 to prevent rotation around axis X during its sliding along the latter.

Therefore, the plunger member 30 may slide along the axis X between an end-stroke position proximal to the pivot 50, corresponding to one of the open and closed position of the second movable tubular half-shell 13, and an end-stroke position distal from the pivot 50, corresponding to the other of the open and closed position of the second movable tubular half-shell 13.

To allow the mutual movement between the plunger member 30 and the pivot 50, the tubular body 52 of the latter may include at least one pair of grooves 70', 70" equal to each other angularly spaced by 180°, each comprising at least one helical portion 71', 71" wound around the axis X.

The grooves 70', 70" may be communicating with each other to define a single passing-through actuating member 72.

Figure 16:
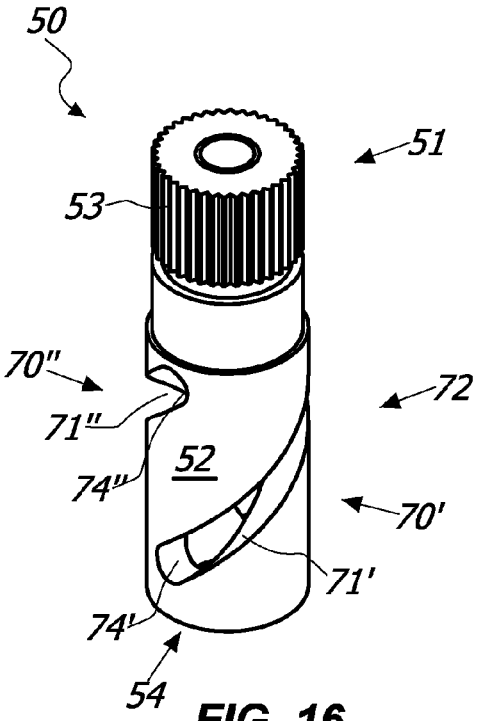
FIGS. 16 and 17 are axonometric views of some embodiments of the pivot 50, wherein the actuating passing-trough element 72 consists of a single helical portion 71', 71" having a constant inclination or helical pitch, the helical portion 71', 71" being wound respectively for 180° and 90° around the axis X.
Figure 17:
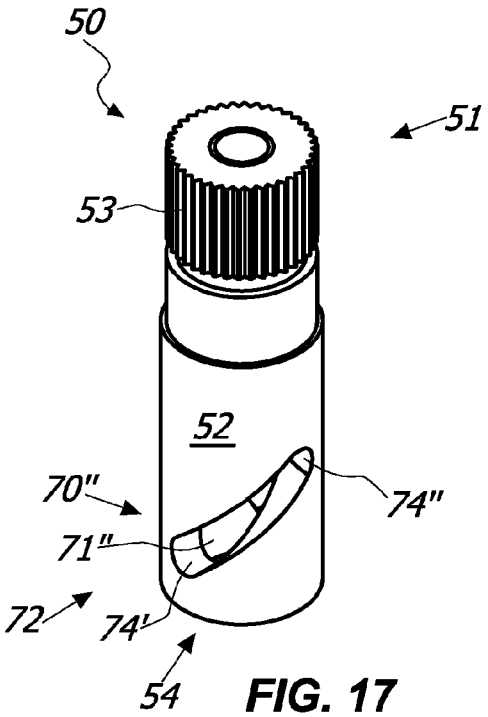

In FIGS. 16 and 17 an embodiment of passing-through actuating member 72 is shown.

Suitably, the at least one helical portion 71', 71" may have any inclination, and may be right-handed, respectively left-handed. Preferably, the at least one helical portion 71', 71" may be wound for at least 90°. around the axis X, and even more preferably for at least 180°.

Advantageously, the at least one helical portion 71', 71" may have a helical pitch P of 20 mm to 100 mm, and preferably of 30 mm to 80 mm.

In a preferred, not exclusive embodiment, each of the grooves 70', 70" may be formed by a single helical portion 71', 71" which may have constant inclination or helical pitch.

Conveniently, the actuating member 72 may be closed at both ends so as to define a closed path having two end blocking points 74', 74" for the pin 73 sliding therethrough, the closed path being defined by the grooves 71', 71".

Irrespective of its position or configuration, the rotation of the actuating member 72 around the axis X allows the mutual movement of the pivot 50 and the plunger member 30.

To guide this rotation, a tubular guide bushing 80 external to the tubular body 52 of the pivot 50 and coaxial thereto may be provided. The guide bushing 80 may include a pair of cam slots 81 angularly spaced by 180°.

To allow the mutual connection between the pivot 50, the elongated element 60 and the guide bushing 80, the second end portion 62 of the elongated element 60 may include a pin 73 inserted through the passing-through actuating member 72 and the cam slots 81 to move within them.

Therefore, the length of the pin 73 may be such as to allow this function. The pin 73 may also define a axis Y substantially perpendicular to the axis X.

As a consequence, upon rotation of the passing-through actuating member 72 the pin 73 is moved by the latter and guided by the cam slots 81.

As already described above, the end portion 16 of the first tubular half-shell 12 may be capable of supporting the pivot 50. The bushing 80, coaxially coupled with the latter, may in turn be unitary coupled with the first tubular half-shell 12, preferably at the same end portion 16, so as to allow the coupling of the first and second tubular half-shell 12, 13.

Advantageously, the tubular portion 52 of the pivot 50 may have an external diameter De' less than or possibly substantially coincident with the internal diameter Di" of the bushing 80.

Moreover, the end portion 16 of the first tubular half-shell 12 may further include a substantially annular appendix 18 having outer diameter De greater than or substantially coincident with the external diameter De' of the tubular portion 52 of the pivot 50, and therefore less than or substantially coincident with the internal diameter Di" of the bushing 80.

The substantially annular appendix 18 may further have an internal diameter Di substantially coincident with the inner diameter Di' of the tubular portion 52 of the pivot 50, and therefore substantially coincident with the diameter D'" of the elongated cylindrical element 60.

More particularly, the substantially annular appendix 18 may further include a lower surface 21 defining the upper wall of the working chamber 20, an upper surface 19' facing the lower portion 54 of the tubular portion 52 of the pivot 50, an inner side surface 19" facing the side wall 63 of the elongated element 60 and a cylindrical outer side surface 19'" facing the inner side wall 83 of the bushing 80 for the unitary coupling thereof with the first tubular half-shell 12. To this end, for example, the wall 19'" may be threaded, while the corresponding coupling portion 85 of the inner wall 83 may be counterthreaded.

Preferably, the second half-shell 13 may have a tubular inner side wall 13' facing the outer side wall 82 of the bushing 80 when the same second tubular half-shell 13 is coupled to the first tubular half-shell 12.

Thanks to one or more of the above features, the hinge device 1 has high performance while being extremely simple to manufacture and cost-effective.

In fact, the bushing 80 has the double function of guiding the pin 73 and of supporting as a column the second movable tubular half-shell 13 which is coupled to the closing element D.

In this way, the vertical component of the weight of the latter is loaded on the stationary support structure S while the horizontal component thereof is distributed over the entire length of the bushing 80, without minimally loading the moving parts of the hinge device 1 and in particular the pivot 50.

This provides higher performances with respect to the devices of the prior art.

Moreover, the first and/or the second tubular half-shell 12, 13 may be made of polymeric material, e.g. polyethylene, ABS or polypropylene, or of metallic material with relatively low mechanical strength, such as aluminum, since their function is predominantly a supporting one and have relatively low wear.

This allows minimizing costs and manufacturing times.

Further, this allows minimizing or eliminating the thermal transmission which occur in the hinges or the hydraulic door closer with metal structure, since the latter transmit to the working fluid the changes of the external temperature, which in turn change the viscosity of the same working fluid and, therefore, change the operational parameters set upon installation.

On the other hand, the pivot 50 and/or the bushing 80, which are more stressed during use, may be made of metallic material with a relatively high mechanical strength, for example hardened steel.

Moreover, the assembly of the hinge device is exceptionally simple, thus simplifying the manufacturing thereof.

As mentioned above, the bushing 80 and the second tubular half-shell 13 may be further coupled each other in a removable manner, for example by sliding the latter onto the former along the axis X and subsequent mutual engagement between the outer shaped surface 53 and the countershaped surface 17.

This greatly simplifies the maintenance operations of the closing element D, as the same may be removed from the operative position by simple lifting it, without disassembling the hinge device 1.

In this case, the second tubular half-shell will remain in operative position on the bushing 80 simply thanks to the gravity force.

FIGS. 9*a* to 15*c* and 18*a* to 19*c* show, to merely illustrate the invention in a non-limitative manner, some embodiments of the bushing 80, which differ each other for the configuration of the guide cam slots 81.

Figure 9A:
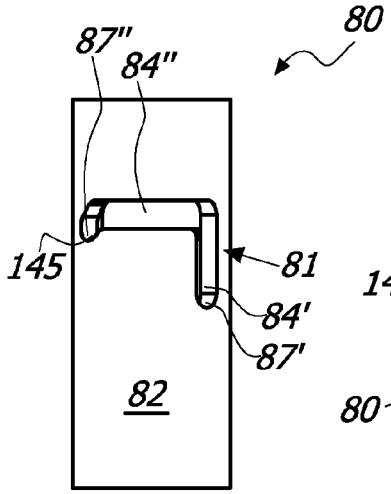
FIGS. 9*a* to 15*c* are side views of some embodiments of the bushing 80, wherein for each embodiment of the latter two axonometric views show the position of the pin 73, the plunger member 30 and the elastic counteracting means 40 in the closed and fully open positions of the second tubular half-shell 13.
Figure 9B:
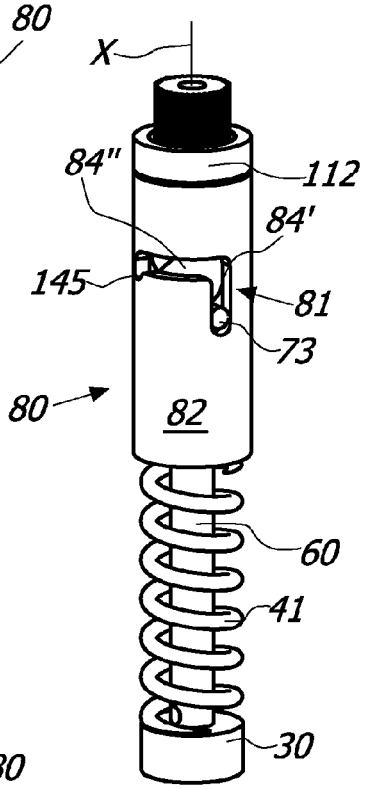
Figure 9C:
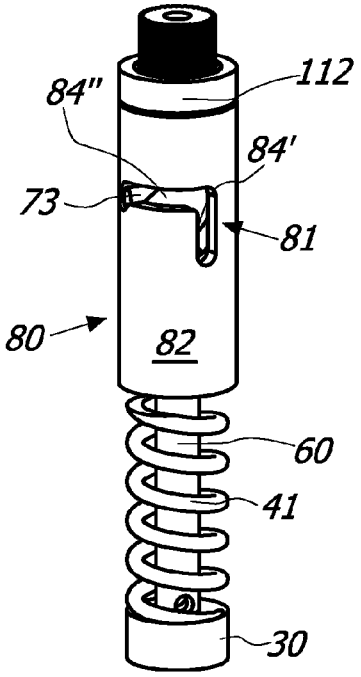

In particular, FIG. 9*a* shows a bushing 80 having guide cam slots 81 that have a first portion 84' extending parallel to the axis X and a subsequent second portion 84" extending perpendicularly thereto.

Both portions 84', 84" may have a length sufficient to guide the rotation of the pivot 50, which is unitary with the second tubular half-shell 13, for 90° around the axis X. Possibly, a stop portion 145 may also be provided for blocking the pin 73 in the desired position, which in the exemplary embodiment shown is at the end of the second portion 84".

This configuration is particularly advantageous in the embodiments of the hinge device 1 that include the elastic means 40, and in particular the compression spring 41.

Thanks to the particular configuration of the guide cam slots 81, the spring 41 can be preload with its highest preloading force, so that with the same size the hinge device of the invention has a greater force than the devices of the prior art, or with the same force the hinge device of the invention has a smaller size.

In fact, when the pin 73 slides along the first portion 84' extending parallel to the axis X, the pivot 50 in rotation about the same axis X compresses the spring 41 for 90°. When the pin 73 slides along the second portion 84" extending perpendicularly to the axis X, the pivot 50 continues to rotate around the same axis X but does not compress the spring 41.

This allows preloading the spring 41 with its highest preloading force, with the above mentioned advantages. It is self-evident that in this case the spring 41 moves only when the pin 73 slides along the first portion 84'.

In this case, the bushing 80 may be for example operatively coupled with the pivot shown in FIG. 16, wherein the passing-through actuating member 72 consists of a single helical portion 71', 71" having constant inclination or helical pitch wound for 180° around the axis X.

Figure 10A:
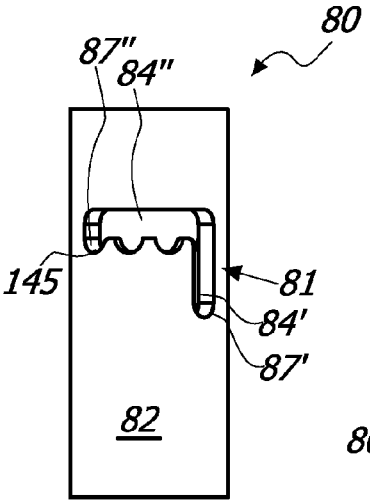
Figure 10B:
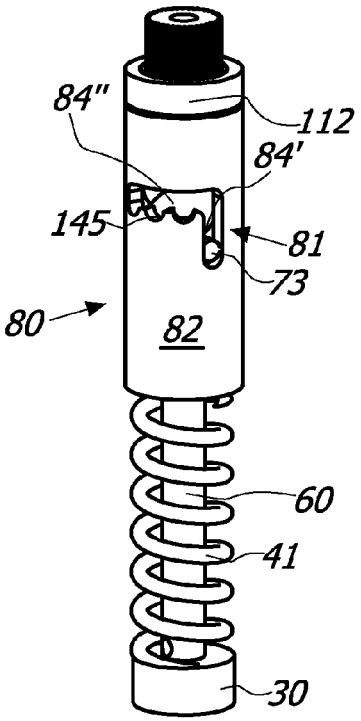
Figure 10C:
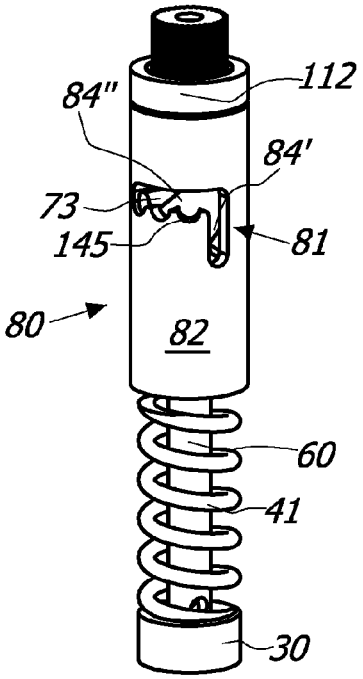

FIG. 10*a* shows a bushing 80 having guide cam slots 81 which have a first portion 84' extending parallel to the axis X and a subsequent second portion 84" extending perpendicularly thereto, and differs from the bushing 80 shown in FIG. 9*a* for the presence of three stop portions 145 along the second portion 84" of the guide cam slots 81.

Figure 11A:
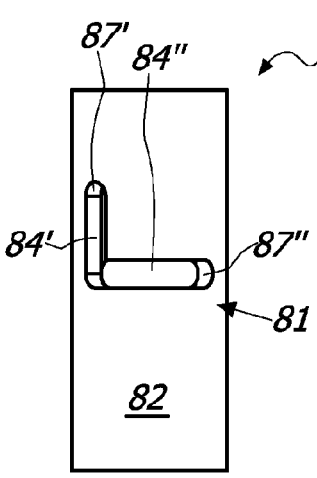
Figure 11B:
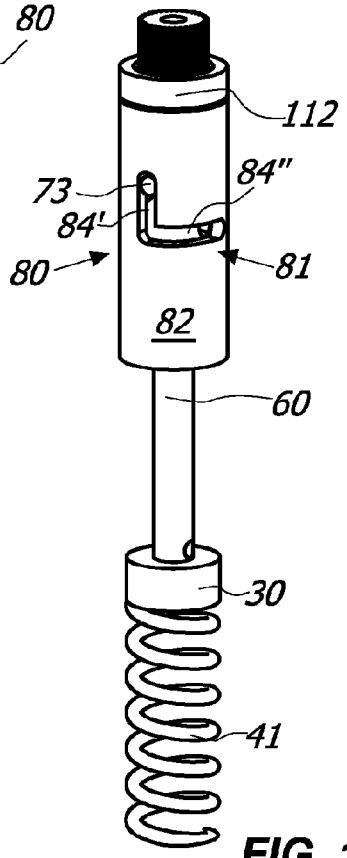
Figure 11C:
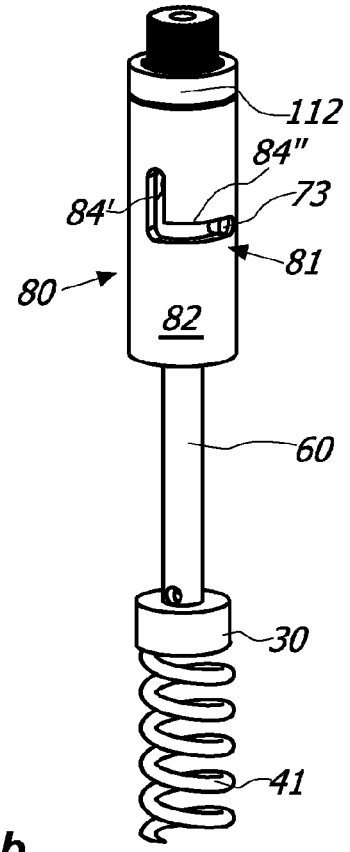

FIG. 11*a* shows a bushing 80 having guide cam slots 81 which have a first portion 84' extending parallel to the axis X and a subsequent second portion 84" extending perpendicularly thereto, and differs from the bushings 80 shown in FIGS. 9*a* and 10*a* for the orientation of the same second portion 84" and for the sliding direction of the pin 73 through the guide cam slots 81.

In fact, in this case the spring 41 is susceptible to push up the pin 73, unlike what occurs in the embodiments shown in FIGS. 9*a* to 10*c*, in which the spring 41 pulls the pin 73 down. The guide cam slots 81 are therefore configured to guide the pin 73 in its path downwards, so as to load the spring 41.

Figure 12A:
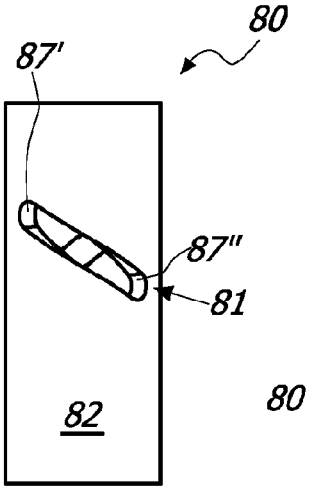
Figure 12B:
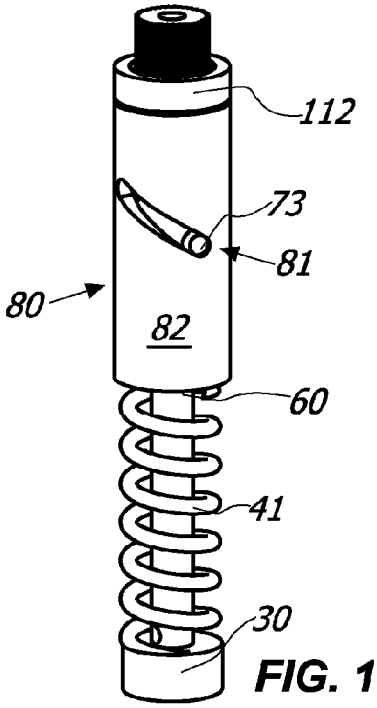
Figure 12C:
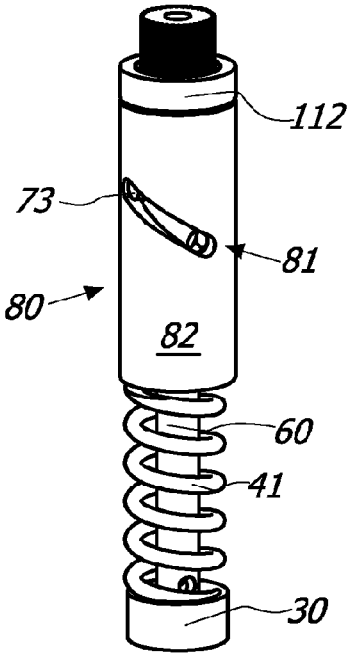
Figure 13A:
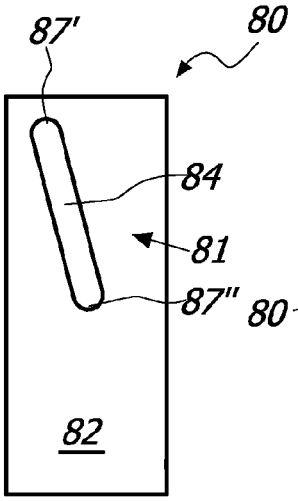
Figure 13B:
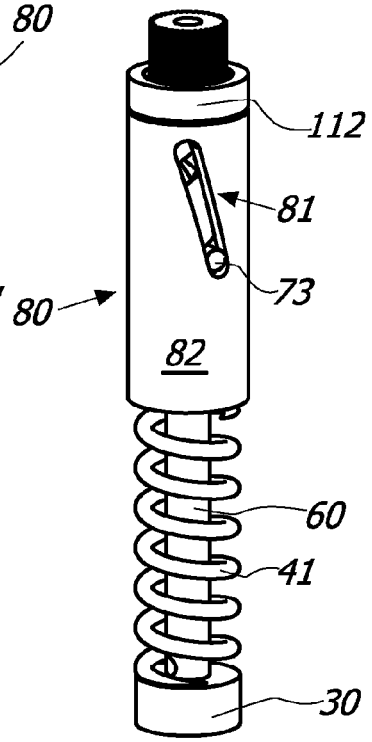
Figure 13C:
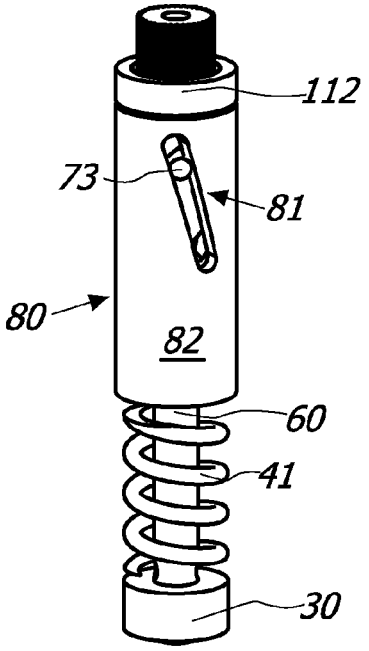
Figure 14A:
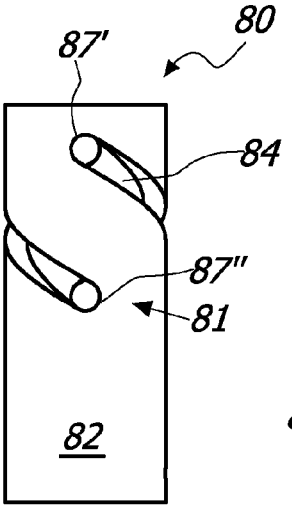
Figure 14B:
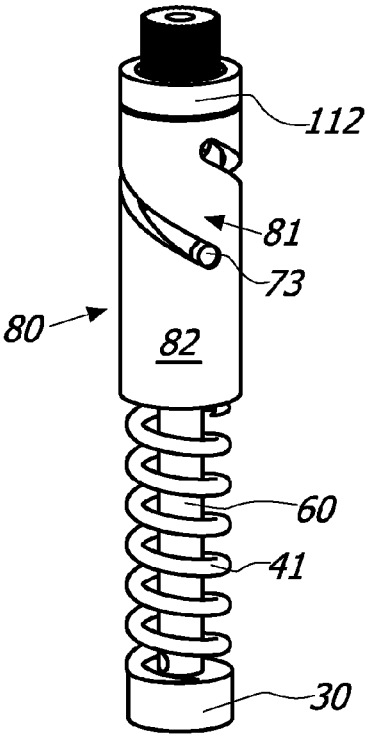
Figure 14C:
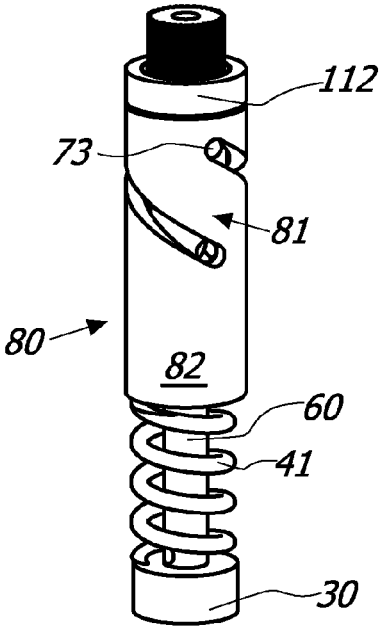

FIGS. 12*a*, 13*a* and 14*a* show bushings 80 having guide cam slots 81 that have a single portion 84 inclined or helical shaped, with predetermined angle or pitch. In this way, there are not intermediate stop points the pin 73 between the closed and the fully open position of the second half-shell 13.

This configuration is extremely advantageous in the case in which the portion 84 has an angle or pitch opposite to the one of the helical portions 71', 71" of the passing-through actuating member 72. In fact, in this case the vertical component of the reaction force that the pin 73 exerts on the guide cam slots 81 upon the sliding therethrough is added to the one given by the passing-through actuating member 72.

This allows obtaining a hinge device that with the same size has a force greater than the devices of the prior art, or with the same force to obtain a hinge device of smaller size.

Figure 15A:
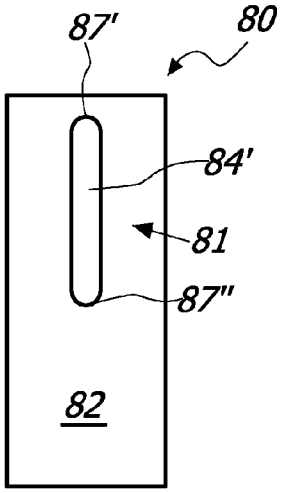
Figure 15B:
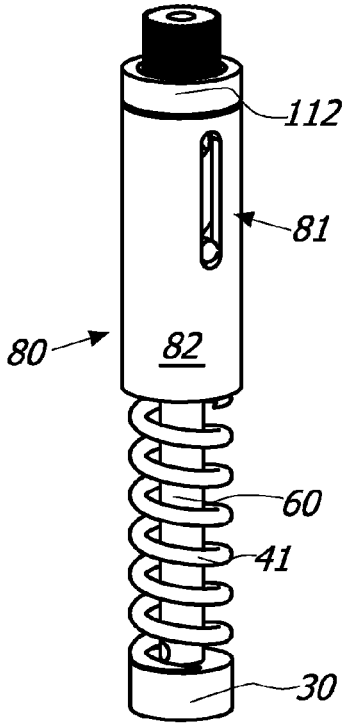
Figure 15C:
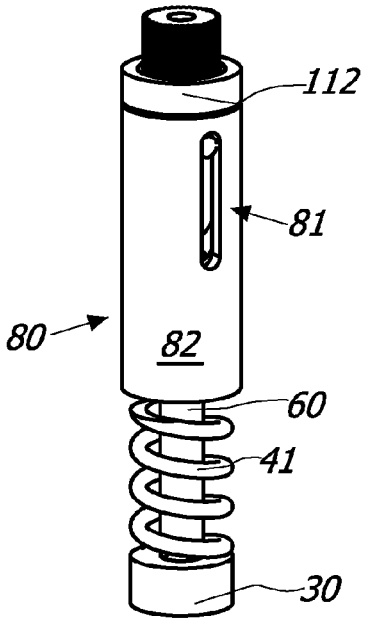

FIG. 15*a* shows a bushing 80 having guide cam slots 81 having a single portion 84' substantially parallel to the axis X.

Figure 18A:
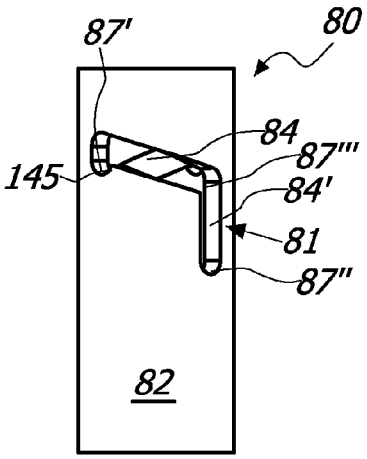
FIGS. 18*a* to 18*c* are further side views of another embodiment of the bushing 80, which show two axonometric views of the position of the pin 73, the plunger member 30 and the elastic counteracting means 40 in the closed and fully open positions of the second tubular half-shell 13.
Figure 18B:
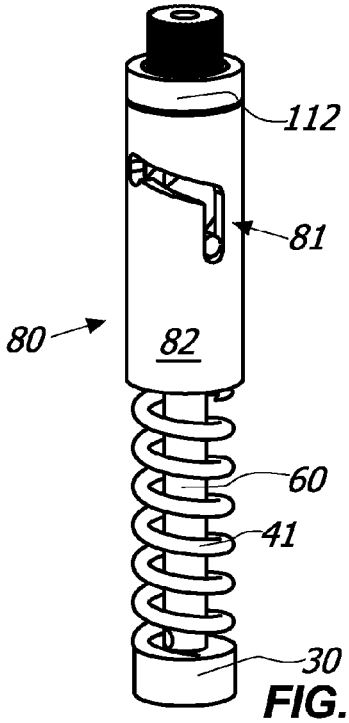
Figure 18C:
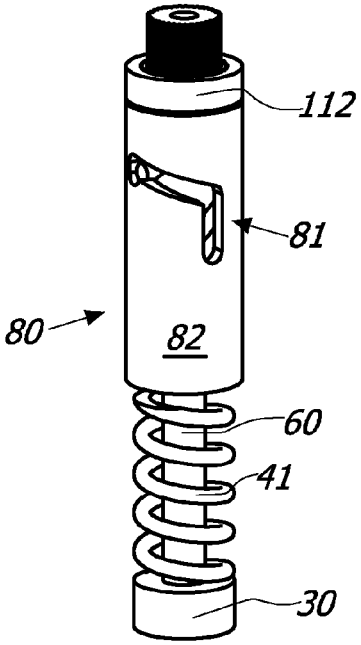
Figure 19A:
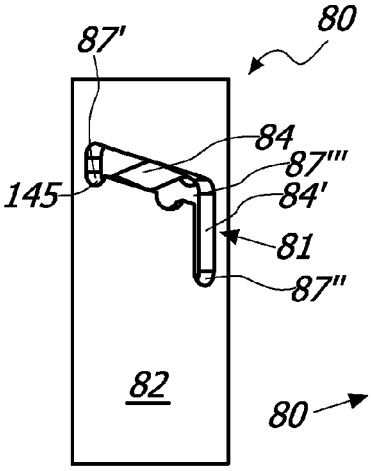
FIGS. 19*a* to 19*d* are further side views of another embodiment of the bushing 80, which show three axonometric views of the position of the pin 73, the plunger member 30 and the elastic counteracting means 40 in the closed, partially open and fully open positions of the second tubular half-shell 13.
Figure 19B:
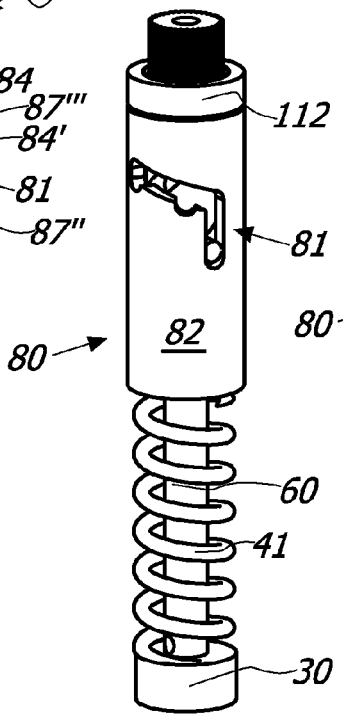
Figure 19C:
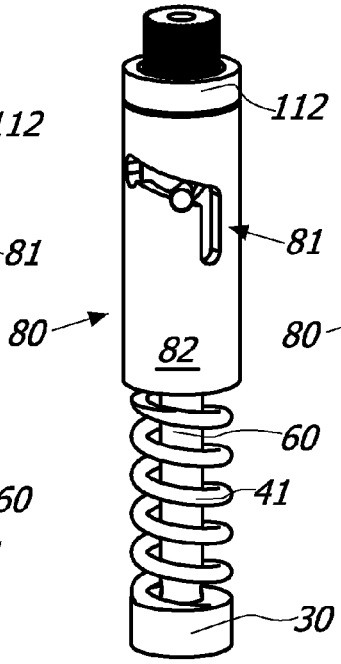
Figure 19D:
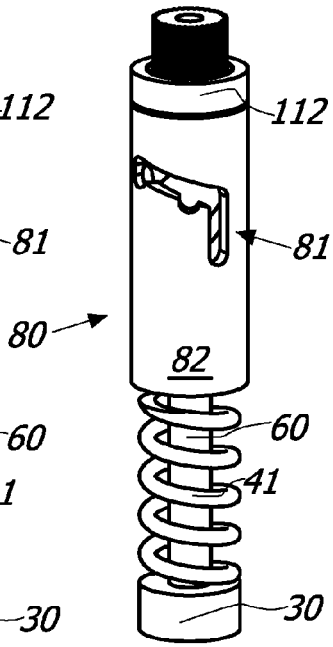
Figure 20:
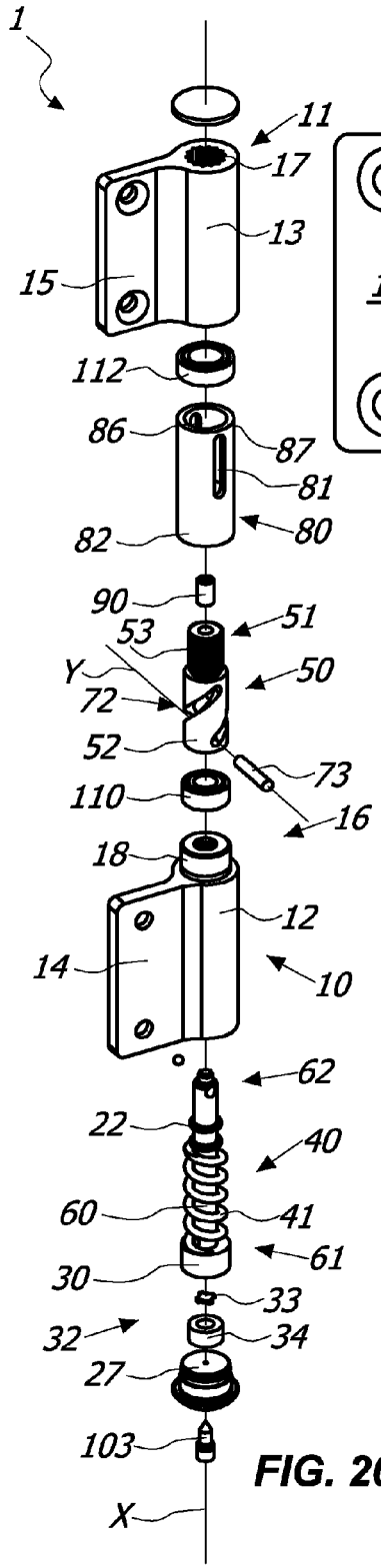
FIG. 20 is an exploded axonometric view of a third embodiment of the hinge device 1, wherein the hydraulic circuit 100 is partially located within the end cap 27.
Figure 21A:
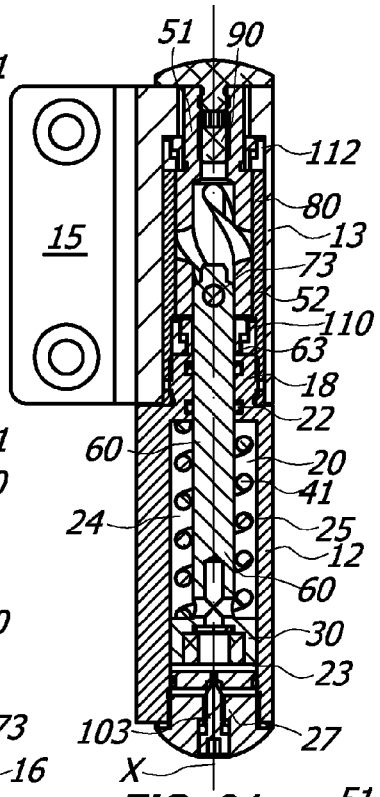
FIGS. 21*a*, 21*b* and 21*c* are axially sectioned views of the hinge device 1 of FIG. 20 respectively in the closed, partially open with the stop screw 90 in the working position and completely open positions.
Figure 21B:
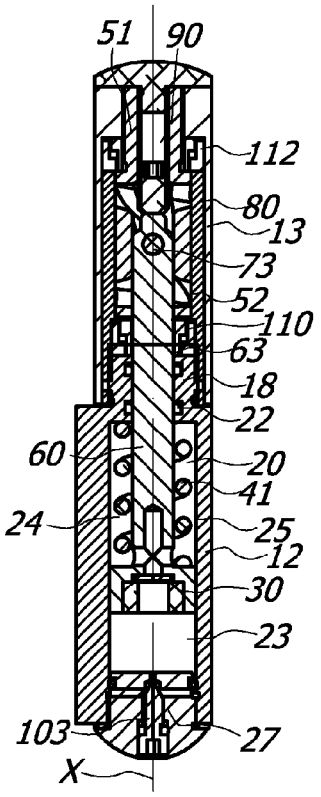
Figure 21C:
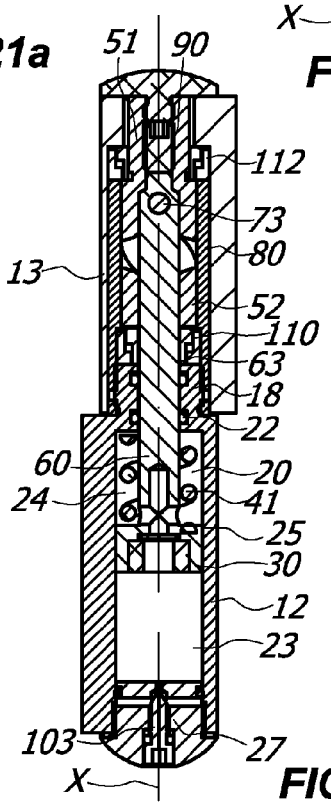
Figure 22:
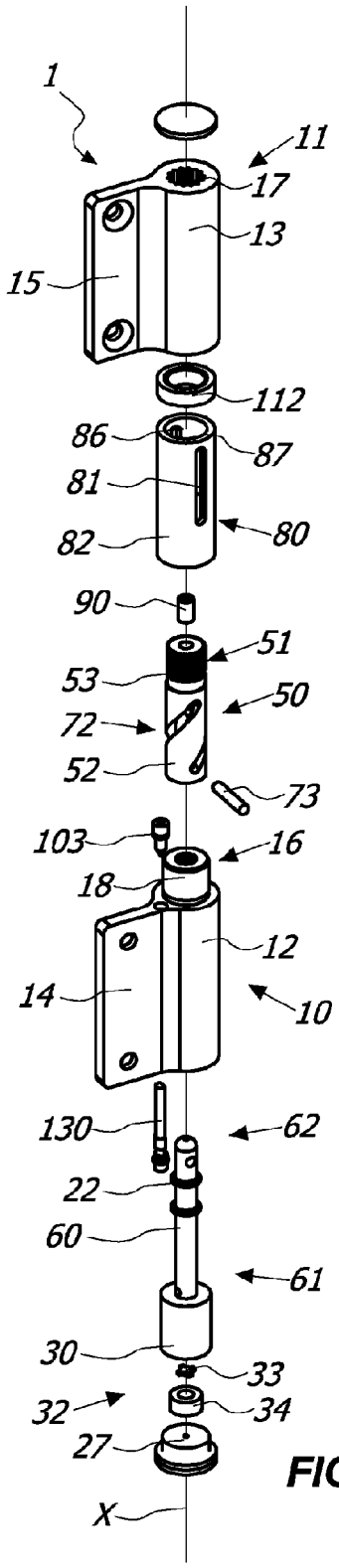
FIG. 22 is an exploded view of a fourth embodiment of the hinge device 1.
Figure 23A:
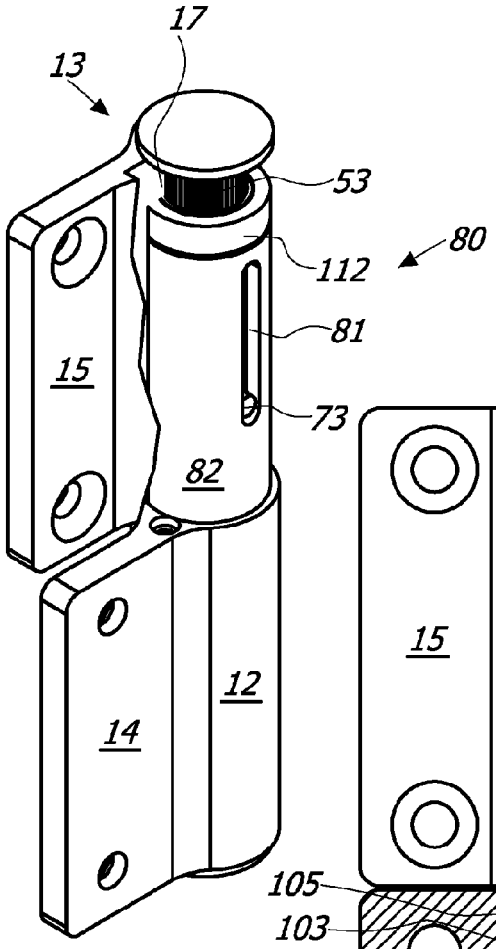
FIGS. 23*a* and 23*b* are respectively axonometric and axially sectioned views of the embodiment of the hinge device 1 of FIG. 22, wherein the second tubular half-shell 13 is in the closed position.
Figure 23B:
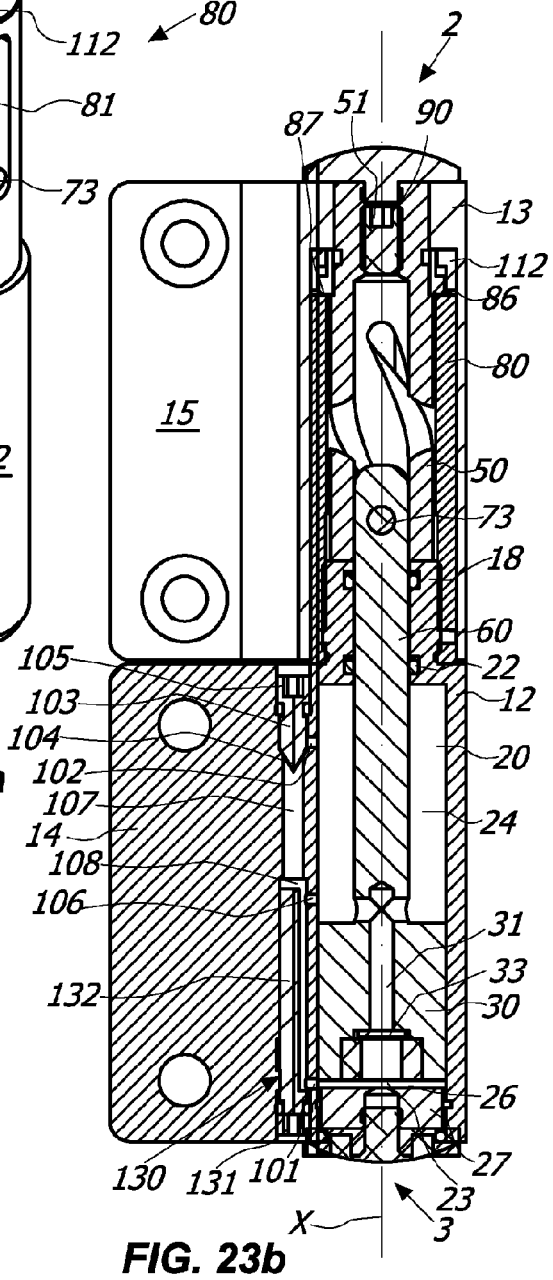
Figure 24A:
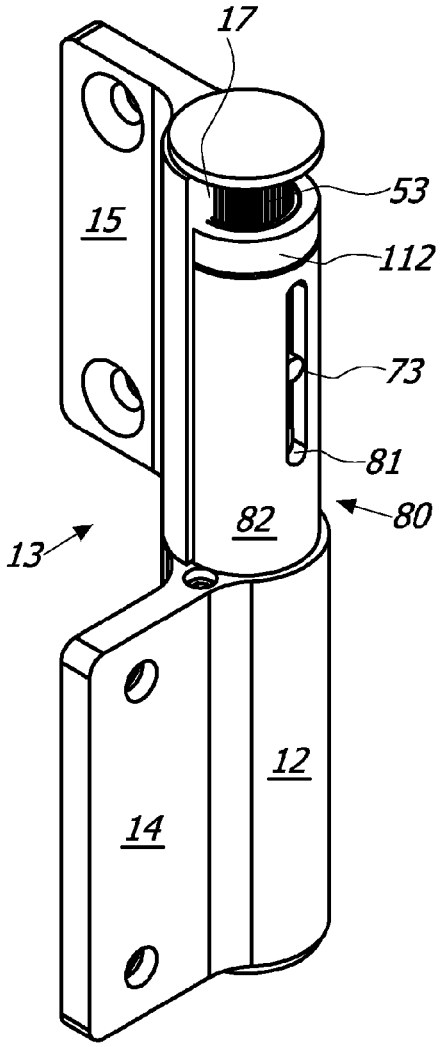
FIGS. 24*a* and 24*b* are respectively axonometric and axially sectioned views of the embodiment of the hinge device 1 of FIG. 22, wherein the second tubular half-shell 13 is in a partially open position with the connecting plate 15 substantially perpendicular to the connecting plate 14 of the first fixed tubular half-shell 12.
Figure 24B:
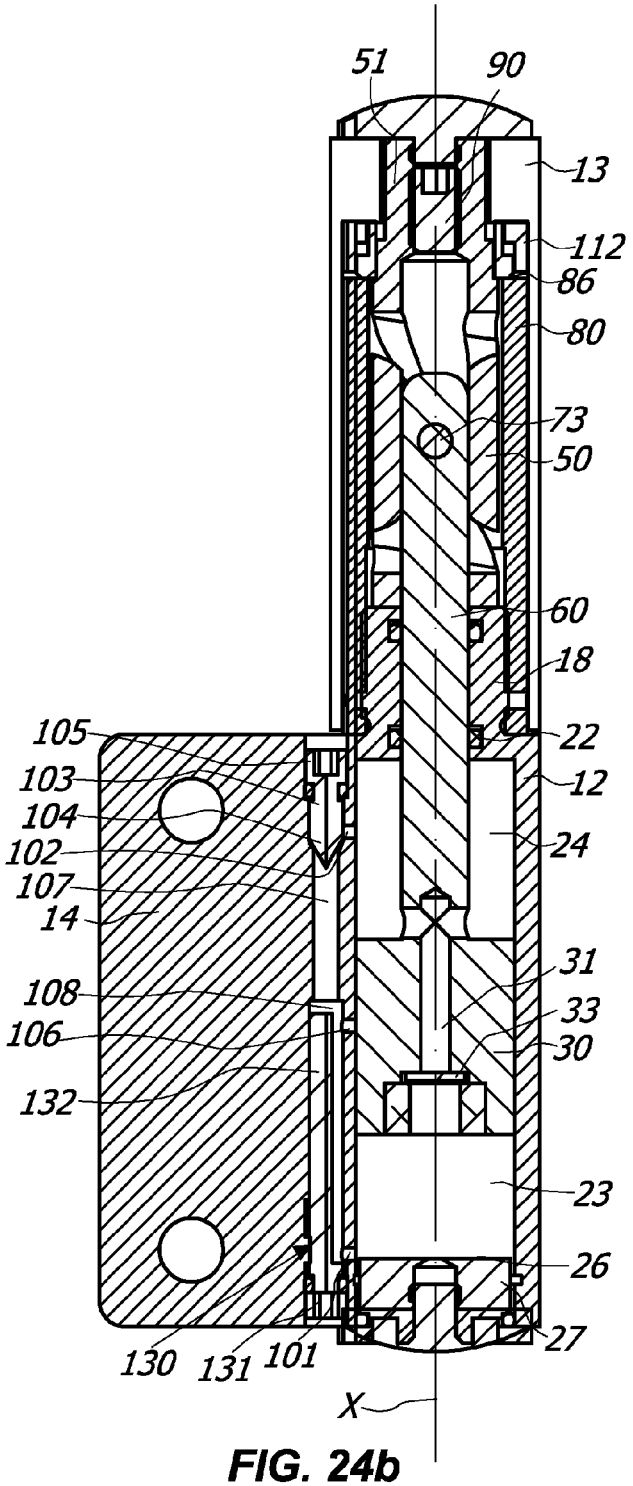
Figure 25A:
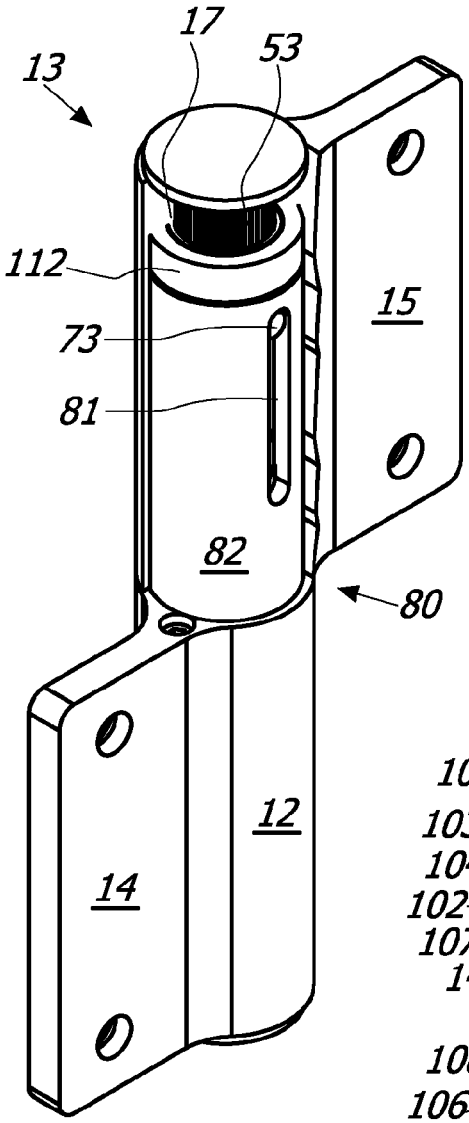
FIGS. 25*a* and 25*b* are respectively axonometric and axially sectioned views of the embodiment of the hinge device 1 of FIG. 22, wherein the second tubular half-shell 13 is in the fully open position with the connecting plate 15 substantially coplanar with the connecting plate 14 of the first fixed tubular half-shell 12.
Figure 25B:
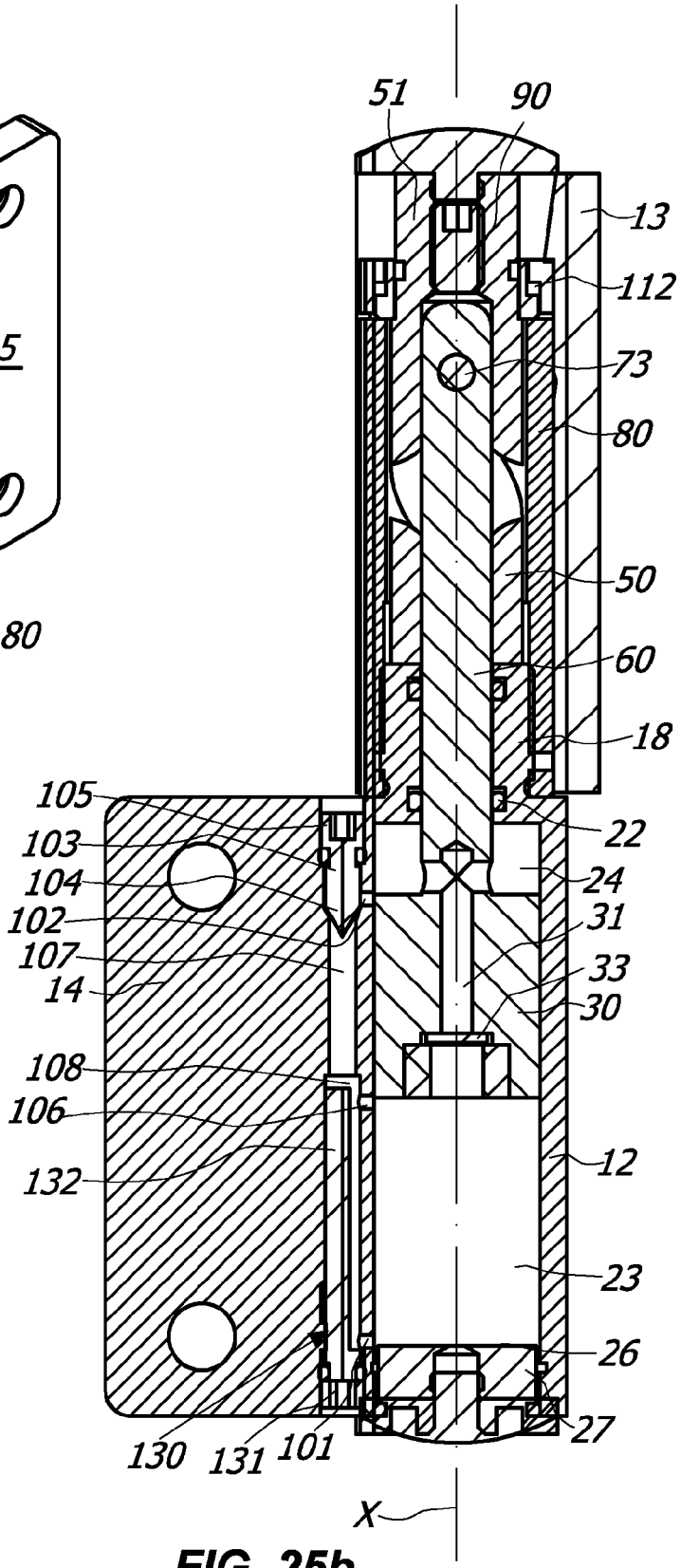
Figure 26:
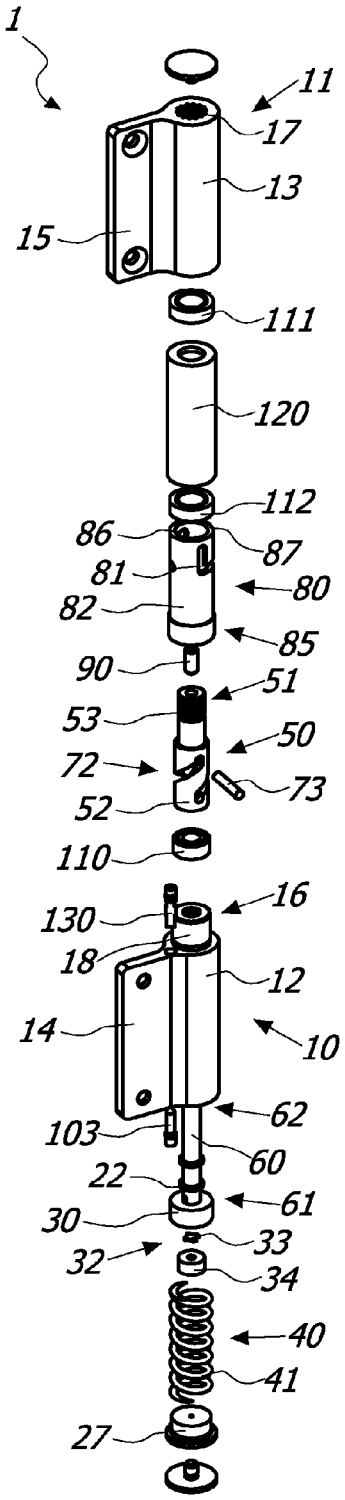
FIG. 26 is an exploded view of a fifth embodiment of the hinge device 1.
Figure 27A:
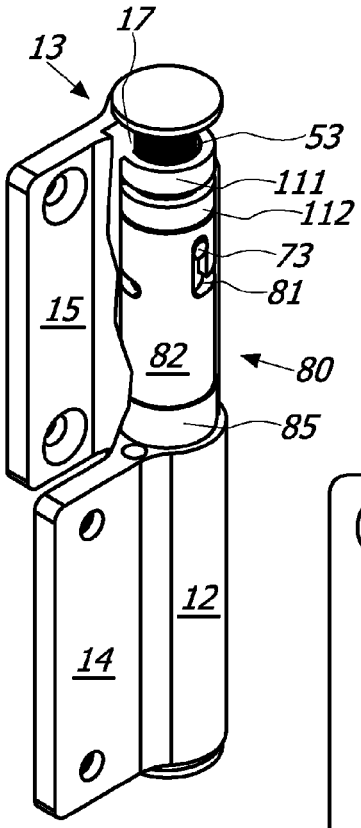
FIGS. 27*a* and 27*b* are respectively axonometric and axially sectioned views of the embodiment of the hinge device 1 of FIG. 26, wherein the second tubular half-shell element 13 is in the closed position.
Figure 27B:
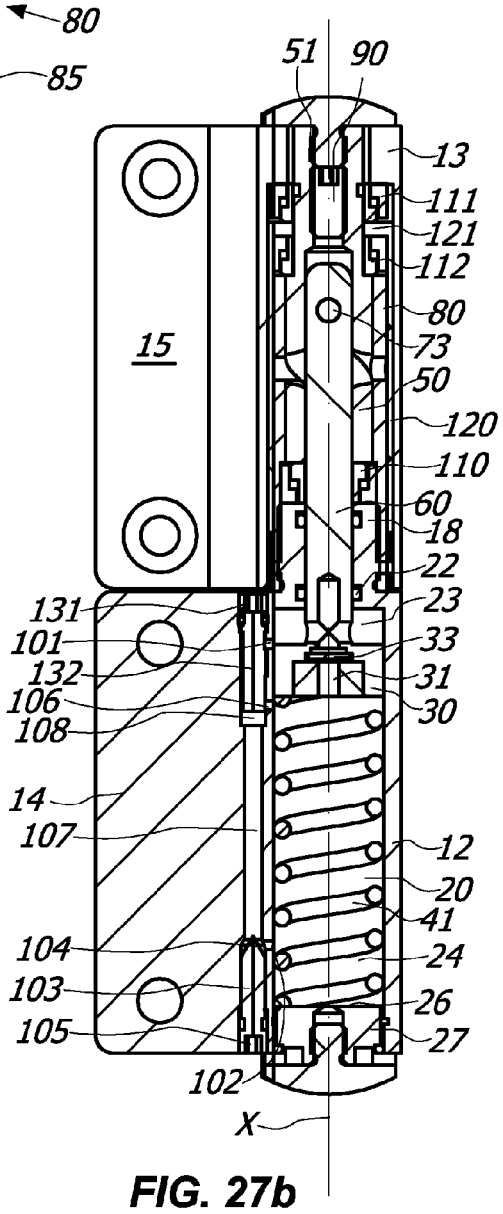
Figure 28A:
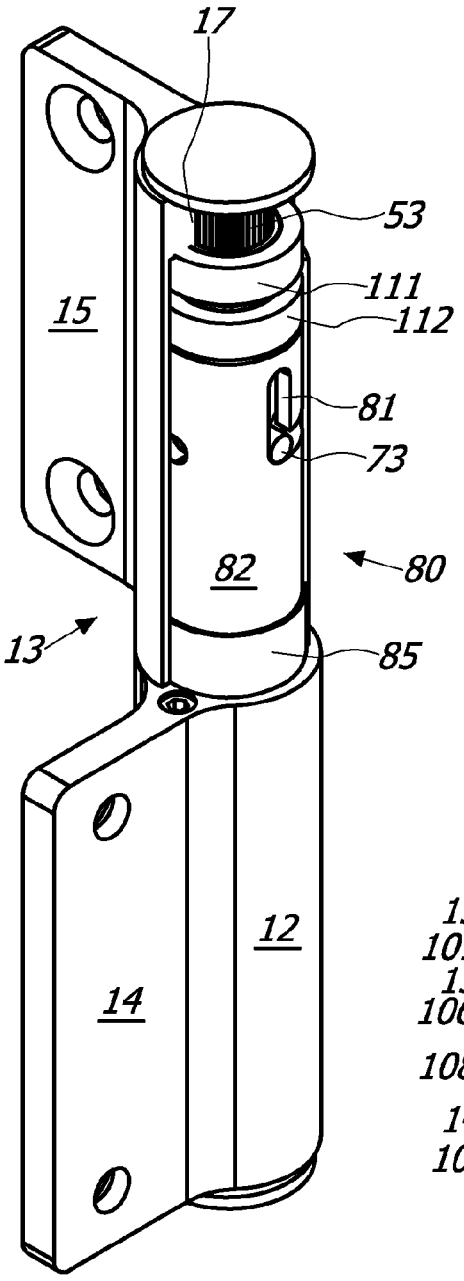
FIGS. 28*a* and 28*b* are respectively axonometric and axially sectioned views of the embodiment of the hinge device 1 of FIG. 26, wherein the second tubular half-shell 13 is in a partially open position with the connecting plate 15 substantially perpendicular to the connecting plate 14 of the first fixed tubular half-shell 12.
Figure 28B:
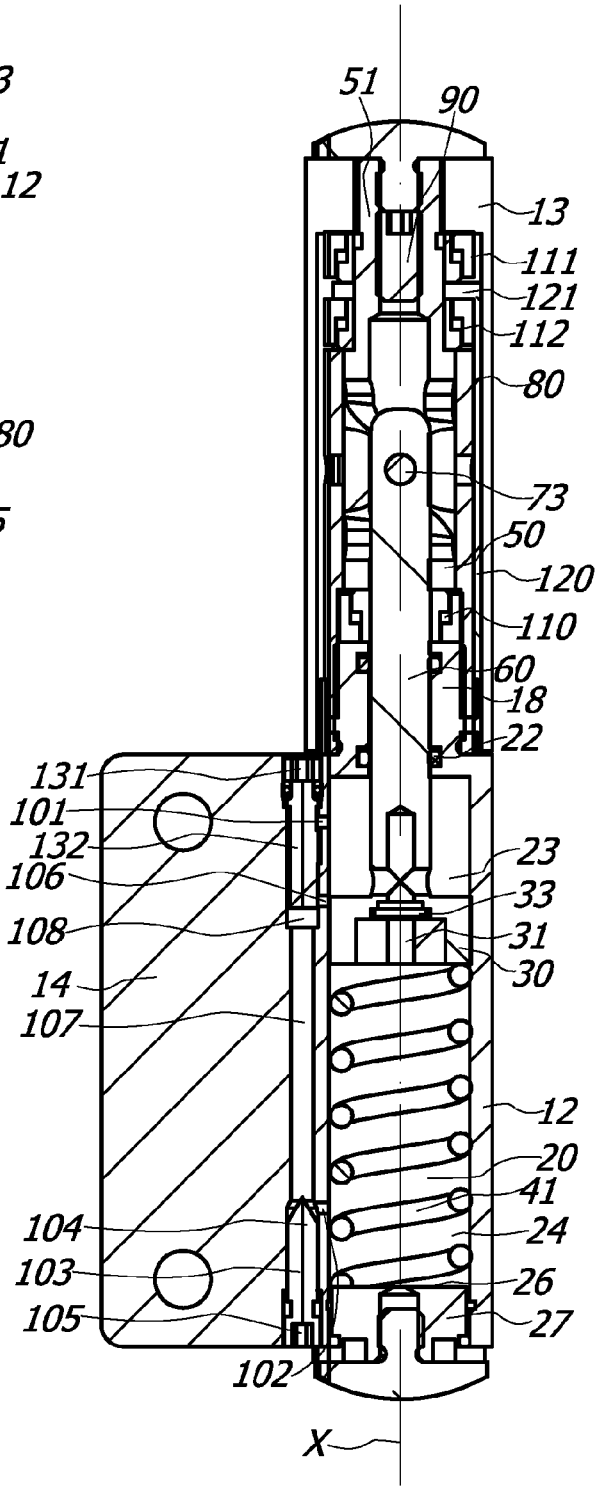
Figure 29A:
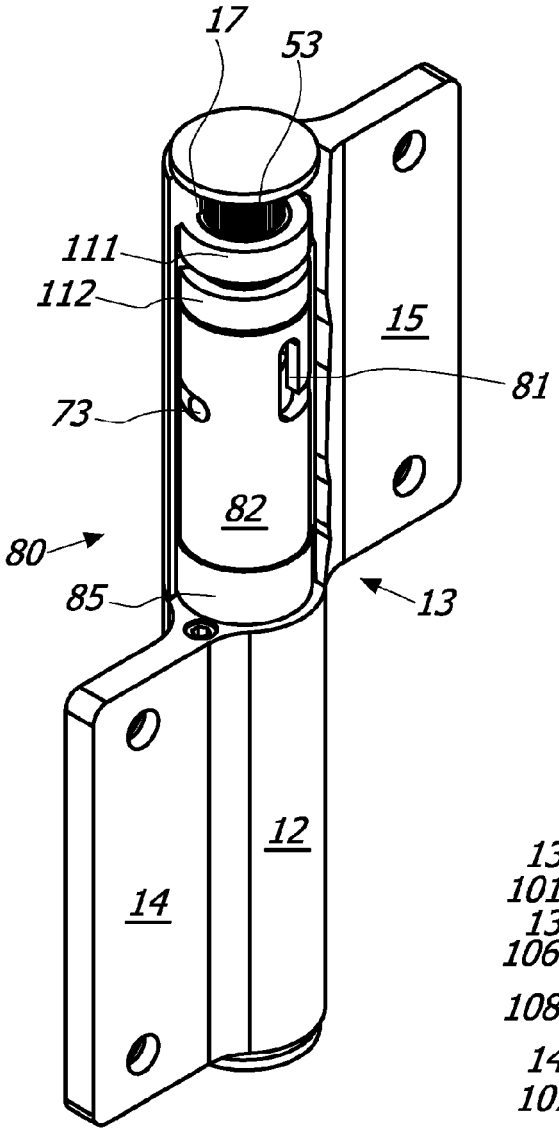
FIGS. 29*a* and 29*b* are respectively axonometric and axially sectioned views of the embodiment of the hinge device 1 of FIG. 26, wherein the second tubular half-shell 13 is in the fully open position with the connecting plate 15 substantially coplanar with the connecting plate 14 of the first fixed tubular half-shell 12.
Figure 29B:
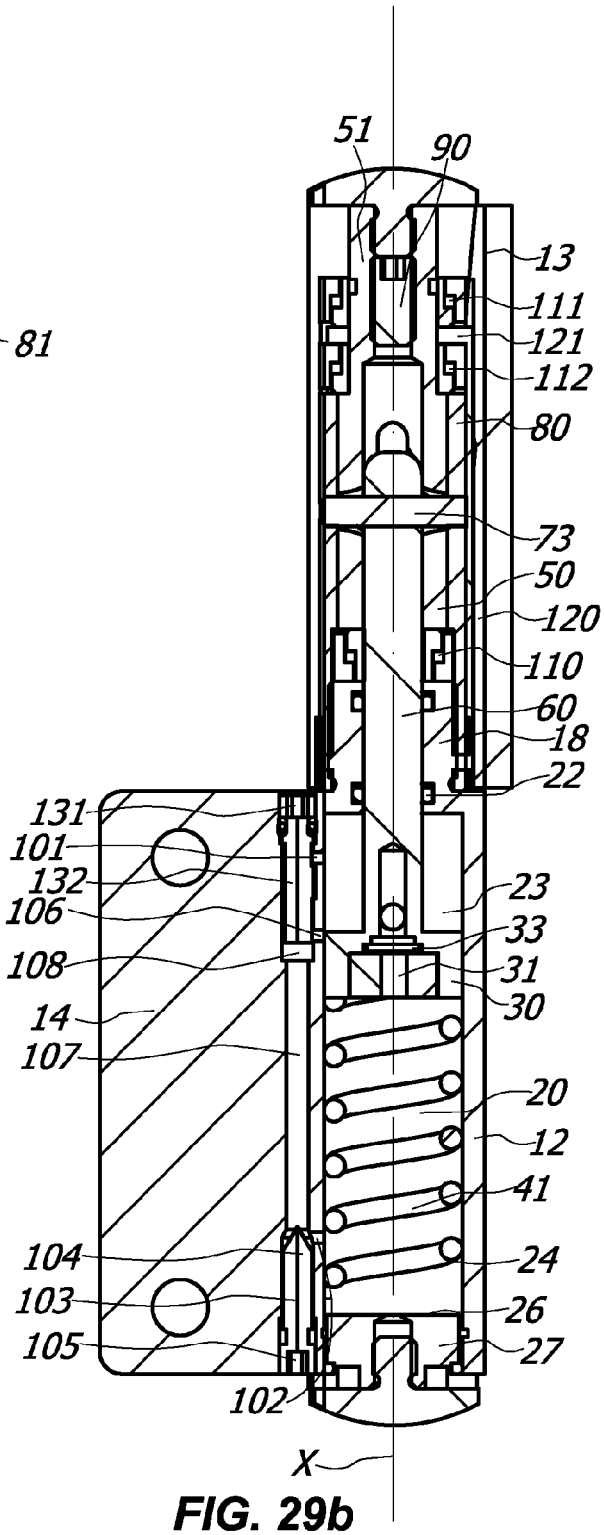
Figure 30:
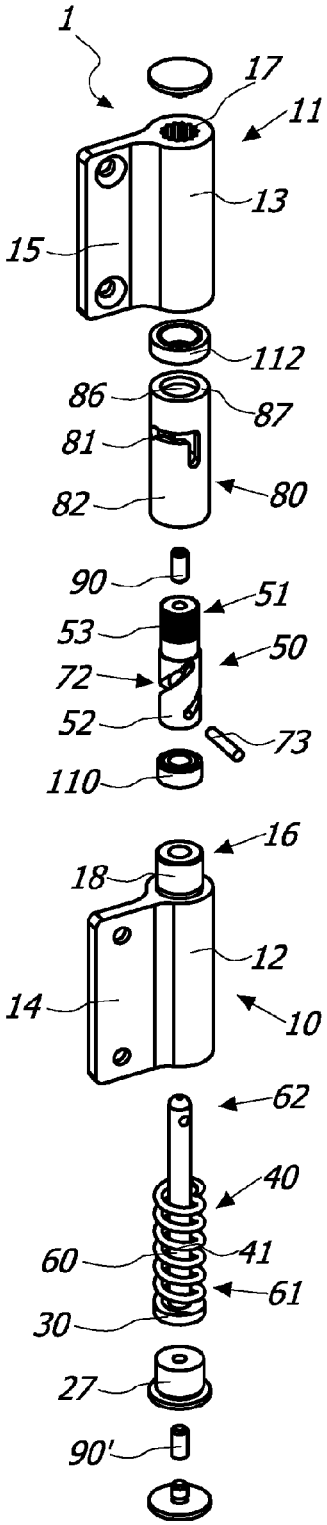
FIG. 30 is an exploded view of a sixth embodiment of the hinge device 1.
Figure 31A:
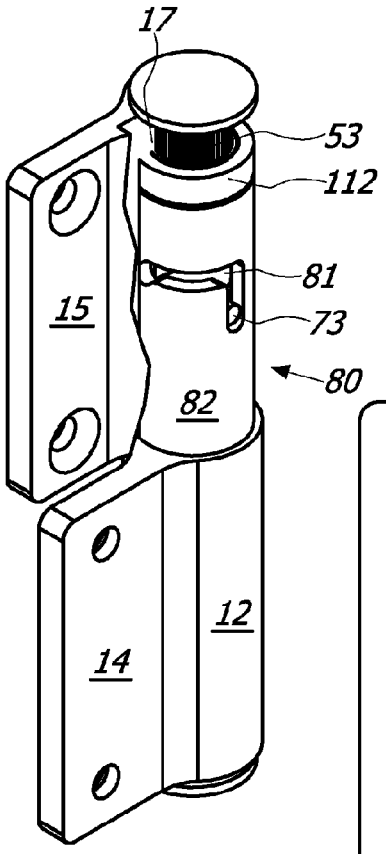
FIGS. 31*a* and 31*b* are respectively axonometric and axially sectioned views of the embodiment of the hinge device 1 of FIG. 30, wherein the second tubular half-shell 13 is in the closed position.
Figure 31B:
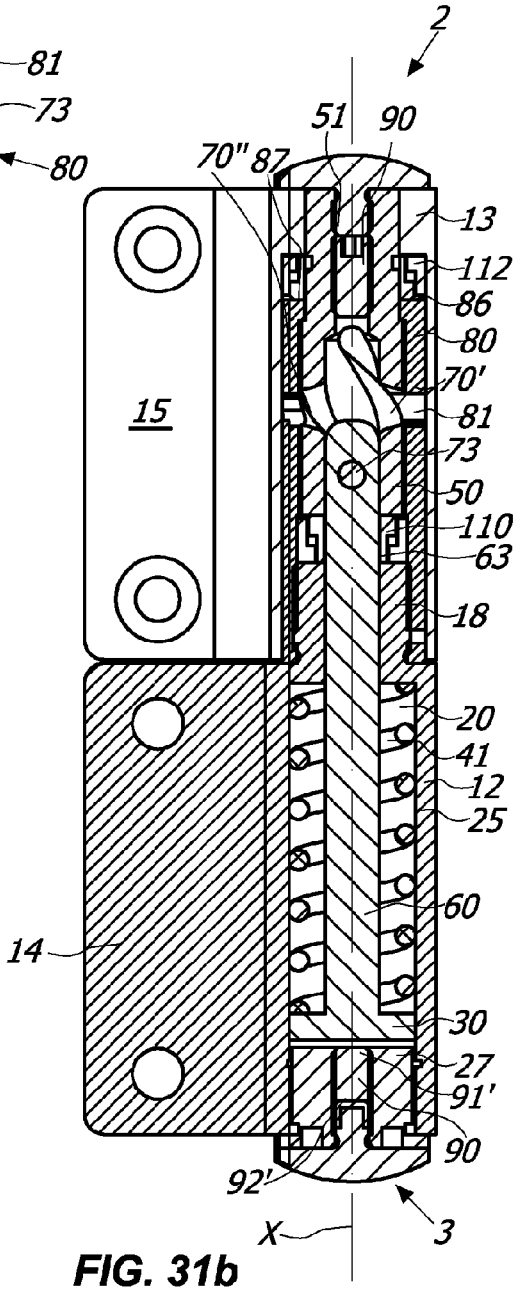
Figure 32A:
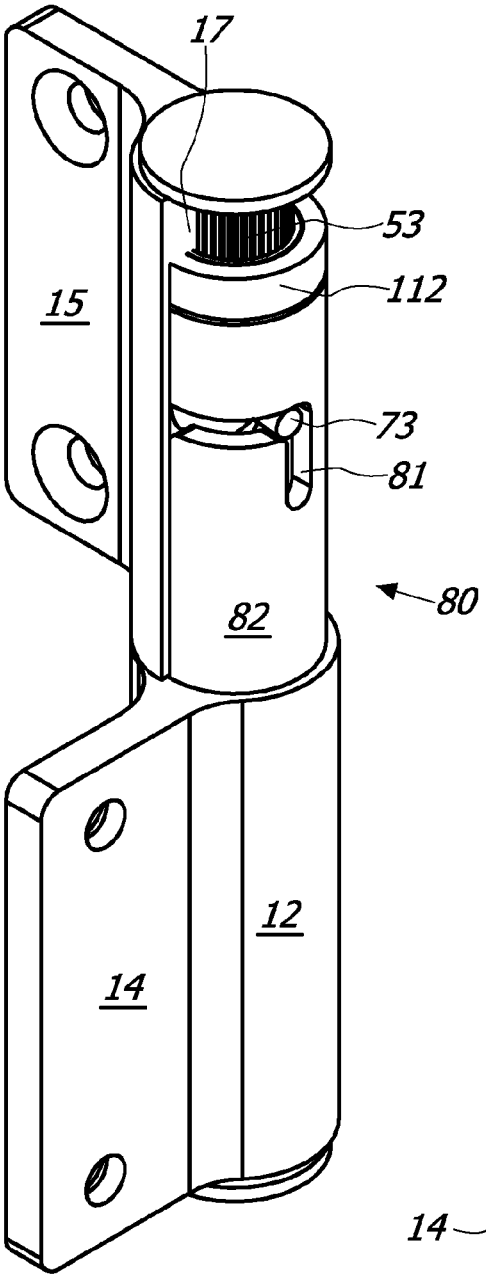
FIGS. 32*a* and 32*b* are respectively axonometric and axially sectioned views of the embodiment of the hinge device 1 of FIG. 30, wherein the second tubular half-shell 13 is in a partially open position with the connecting plate 15 substantially perpendicular to the connecting plate 14 of the first fixed tubular half-shell 12 and wherein the stop screw 90 is in the rest position.
Figure 32B:
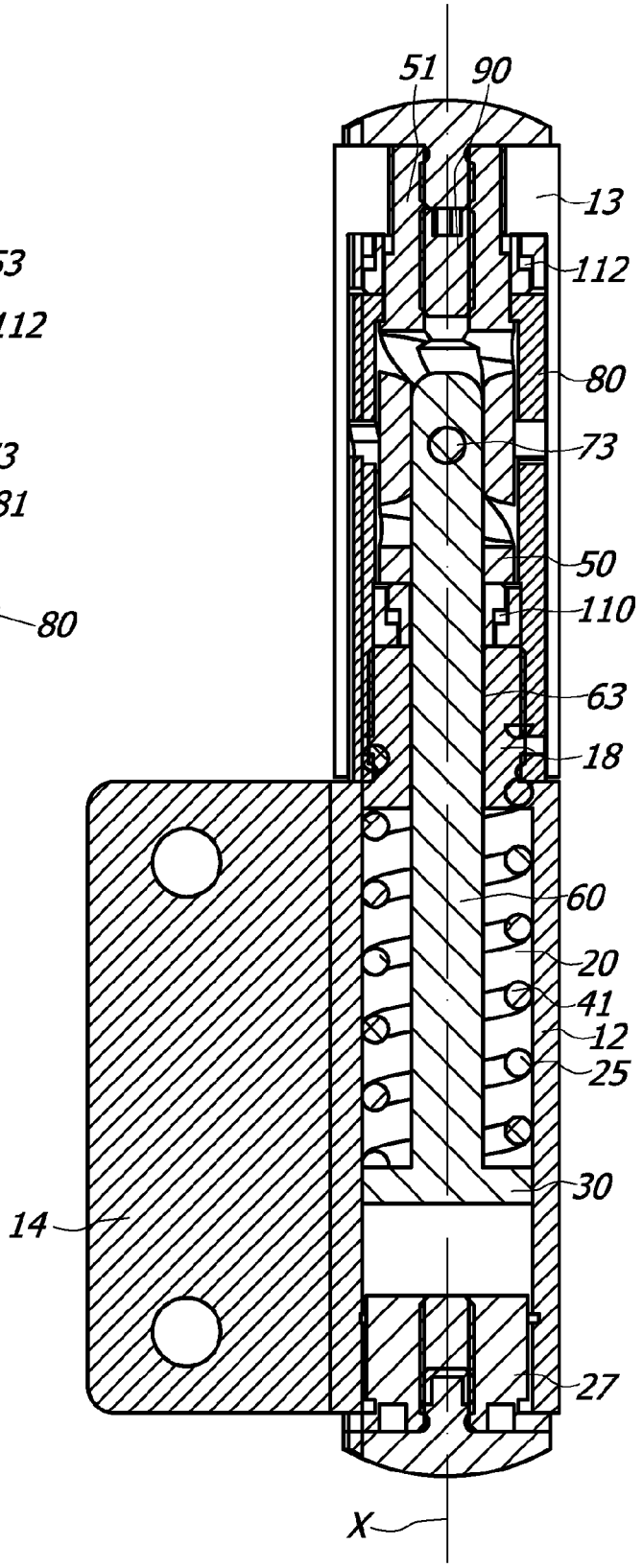

FIG. 18*a* shows a bushing 80 having guide cam slots 81 that have a first portion 84 and a subsequent second portion 84' extending perpendicularly to the axis X. The first portion 84 may be inclined or helical with predetermined angle or pitch. The angle may be less than 30°, preferably less than 25° and even more preferably close to 20°, and may have angle or pitch opposite to that of the helical portion 71', 71" of the passing-through actuating member 72.

This allows combining the advantages described above, for example for the bushings 80 of FIGS. 9*a* to 12*a*. In fact, the first portion 84, with its slight angle allows preloading with the highest preloading force the spring 41, while the second portion 84' allows maximizing this force upon closing or opening. In practice, a closing element D potentially without blocking points is obtained, except those in correspondence of a possible stop portions 145, which has high closing or opening force and double speed, at first slow and then fast or vice-versa. Moreover, by acting on the stop screw 90 it is possible to obtain practically any opening or closing angle between 0° and 180°.

It is understood that each of the embodiments of the hinge device 1 shown in the FIGS. 1 to 8*d* and 18 to 42*b* may include any one of the bushings 80 shown in FIGS. 9*a* to 15*c* and 18*a* to 19*c*, as well as pivots 50 having the at least one helical portion 71', 71" either right-handed or left-handed, without departing from the scope of the invention defined by the appended claims.

Regardless of the shape of the cam slots 81, the latter may be closed at both ends so as to define a closed path having two end blocking points 87', 87" for the pin 73 sliding therethrough.

FIGS. 45*a* to 46*b* show further embodiments of the bushing 80, in which the cam slots 81 may include a first portion 84' and a second portion 84".

Figure 45A:
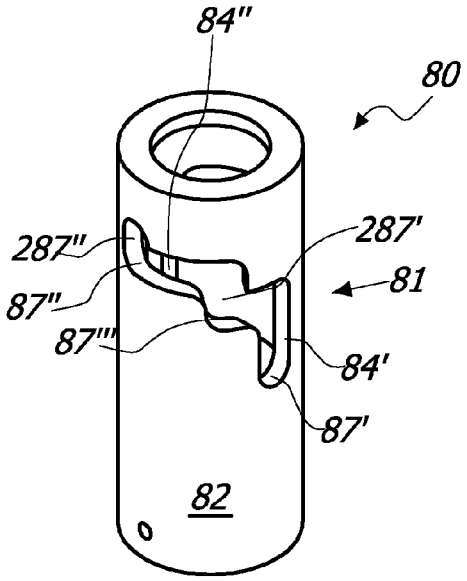
FIGS. 45*a* and 45*b* are axonometric views of another embodiment of the bushing 80.
Figure 45B:
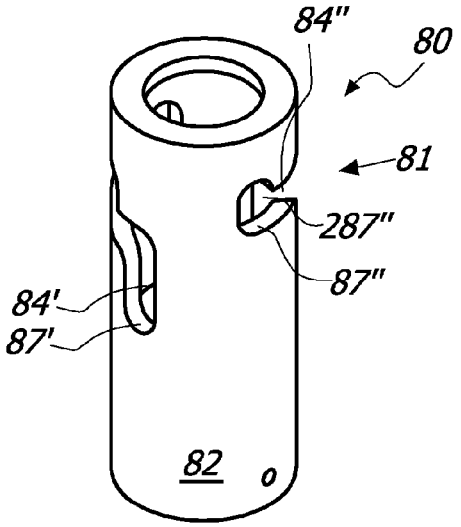
Figure 46A:
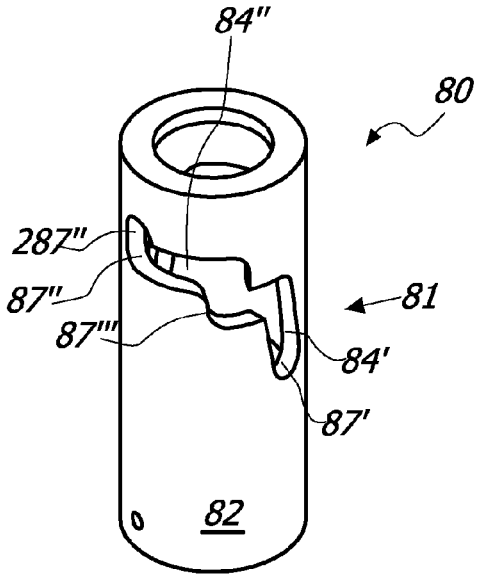
FIGS. 46*a* and 46*b* are axonometric views of a further embodiment of the bushing 80.
Figure 46B:
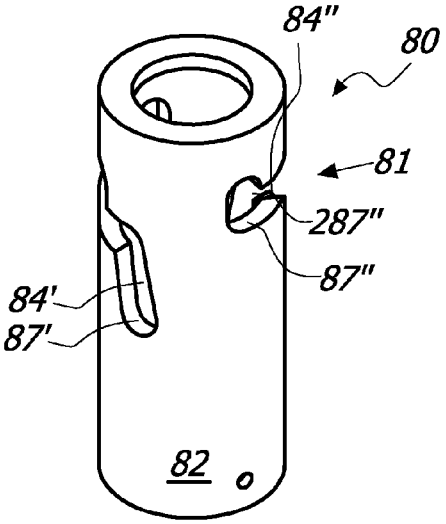

The first portion 84' may extend substantially parallel to the axis X, as shown in FIGS. 45*a* and 45*b*, or may be slightly inclined with respect to the same axis X with opposite inclination with respect to that of the grooves 70', 70" of the pivot 50, as shown in FIGS. 46*a* and 46*b*.

On the other hand, the second portion 84" may extend substantially perpendicularly to the axis X.

Suitably, the first and the second portion 84', 84" may each have a length sufficient to guide the rotation of the movable tubular half-shell 13 for 90° around the axis X.

FIGS. 47*a* to 47*e* show a hinge device 1 that includes the bushing 80 in accordance with FIGS. 45*a* and 45*b*.

Figures 47A, 47B, 47C, 47D, 47E:
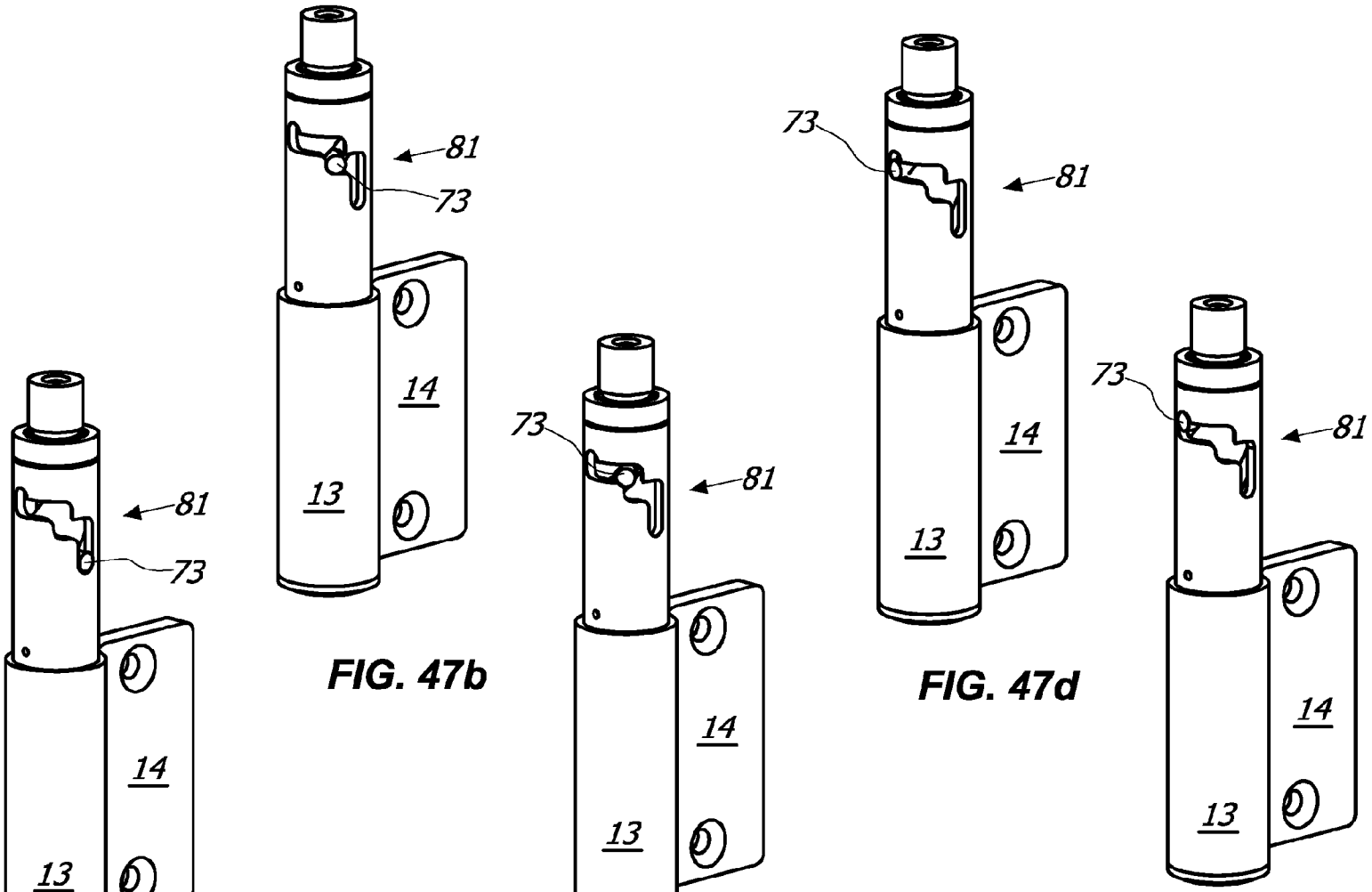
FIGS. 47*a* to 47*e* are axonometric views of a hinge device 1 which includes the embodiment of the bushing 80 of FIGS. 46*a* and 46*b* wherein the pin 73 is in several positions along the cam slots 81.

FIG. 47*a* shows the position completely closed of the closing element D. The pin 73 is in correspondence of the first end blocking point 87'.

FIG. 47*b* shows the position of the closing element D at 90° with respect to the closed door position. The pin 73 is in correspondence of an intermediate blocking point 87".

In correspondence of the latter a first shock-absorbing portion 287' may be provided that extends substantially parallel to the axis X in a direction concordant to the sliding direction of the pin 73 within the first portion 84' to allow a further minimum compression of the spring 41, for example of 1-2 mm, which may correspond to a further slight rotation of the movable tubular half-shell 13. In the embodiment shown, the first shock-absorbing portion 287' guides the pin 73 so as to rotate the closing element D from 90°, which position is shown in FIGS. 47*b*, to 120° with respect to the closed door position, as shown in FIG. 47*c*.

FIG. 47*d* shows the position of closing element D at 180° with respect to the closed door position. The pin 73 is in correspondence of the second blocking point 87".

In correspondence of the latter a second shock-absorbing portion 287" may be provided to guide the pin 73 so as to rotate the closing element D from 180°, which position is shown in FIGS. 47*d*, to 190° with respect to the door closed position, as shown in FIG. 47*e*.

Advantageously, the blocking points 87', 87", 87" may include zones of the cam slots 81 against which the pin 73 abuts during its sliding through the same cam slots 81 to block the closing element D during opening and/or closing.

It is pointed out that the blocking points 87', 87", 87" are different from the stop portions 145, and have also different functions.

The shock-absorbing portions 287', 287" allow absorbing the shock imparted to the closing element D by the abutment of the pin 73 against the blocking points 87', 87".

In fact, this abutment is rigidly transferred to the closing element D, with the consequent unhinging danger thereof. Therefore, the shock-absorbing portions 287', 287" allow a further compression of the spring 41 which absorb the shock of the abutment of the pin 73 against the blocking points 87", 87', thus avoiding the above danger.

This configuration is particularly advantageous in case of aluminum frames, so as to avoid the reciprocal torsion of the closing element D and the stationary support structure S.

Suitably, the shock-absorbing portions 287', 287" may have a length sufficient to allow a further minimum rotation of the movable element 11 of 5° to 15° around the axis X.

A further advantage of the above configuration is that even if the closing element D rotates beyond the open position determined by the blocking points 87", 87', the spring 41 returns the same closing element D in the predetermined open position. Therefore, the action of the shock-absorbing portions 287', 287" does not affect the predetermined open position of the closing element D, which therefore is maintained over time even in the case of several shock-absorbing actions.

It is understood that both the blocking points that the shock-absorbing portions of the cam slots 81 may be in any number without departing from the scope of the appended claims.

In order to allow a user to adjust the opening and/or closing angle of the second tubular half-shell 13, at least one stop screw 90 may be provided having a first end 91 susceptible to selectively interact with the second end portion 62 of the elongated element 60 and a second end 92 to be operated from the outside by a user to adjust the stroke of the same elongated element 60 along the axis X.

Preferably, the at least one stop screw 90 can be inserted within the pivot 50 in correspondence of the end portion 51 thereof, so as to slide along the axis X between a rest position spaced from the second end portion 62 of the elongated element 60 and a working position in contact therewith.

In this way, it is possible to adjust the hinge device 1 in any manner.

Figure 4A:
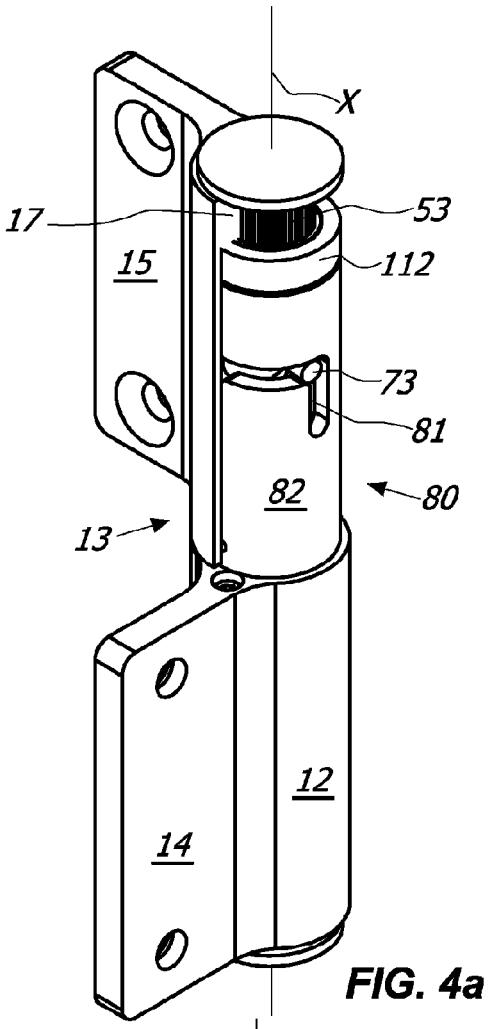
FIGS. 4*a* and 4*b* are respectively axonometric and axially sectioned views of the first embodiment of the hinge device 1 of FIG. 1, wherein the second tubular half-shell 13 is in a partially open position with the connecting plate 15 substantially perpendicular to the connecting plate 14 of the first fixed tubular half-shell 12 and wherein the stop screw 90 is in working position to block the sliding of the elongated element 60.
Figure 4B:
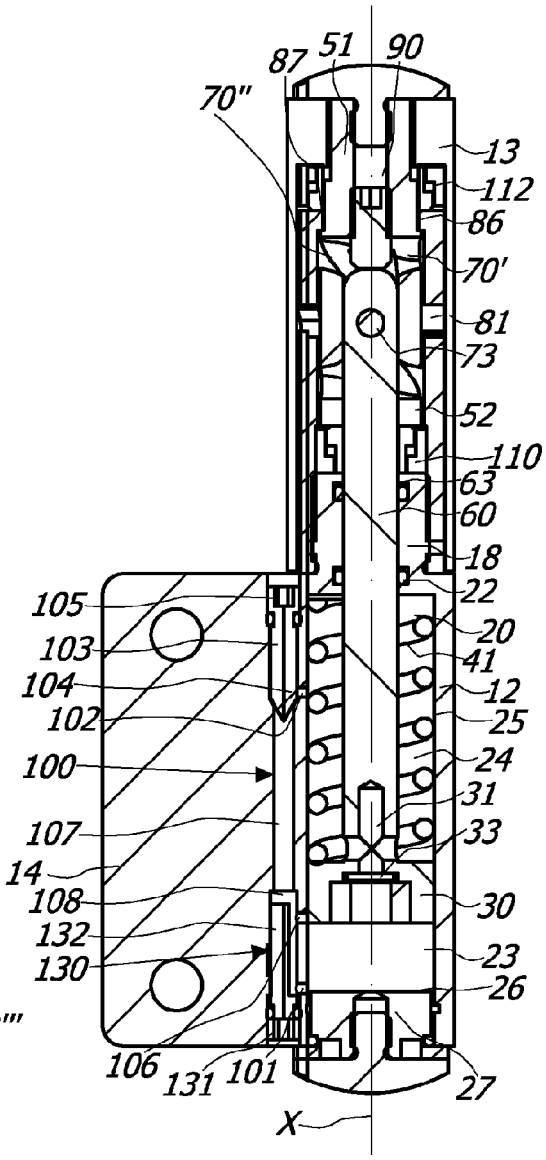
Figure 4C:
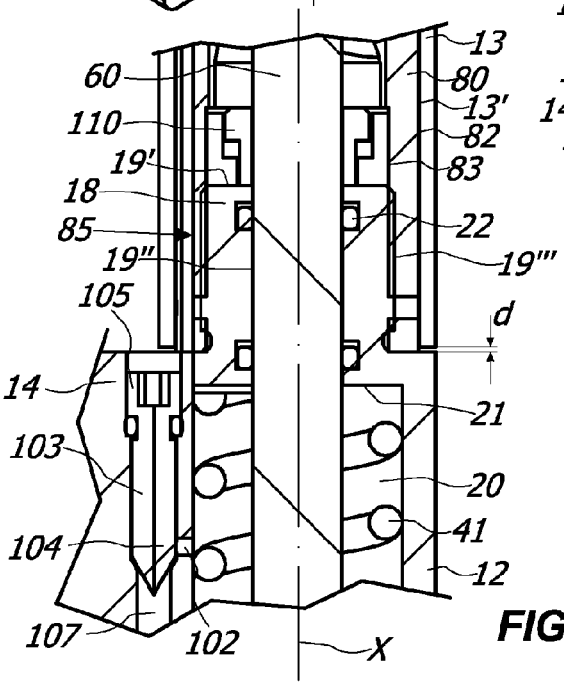
FIG. 4*c* is an axially sectioned enlarged view of some details of the first embodiment of the hinge device 1 of FIG. 1.
Figure 5A:
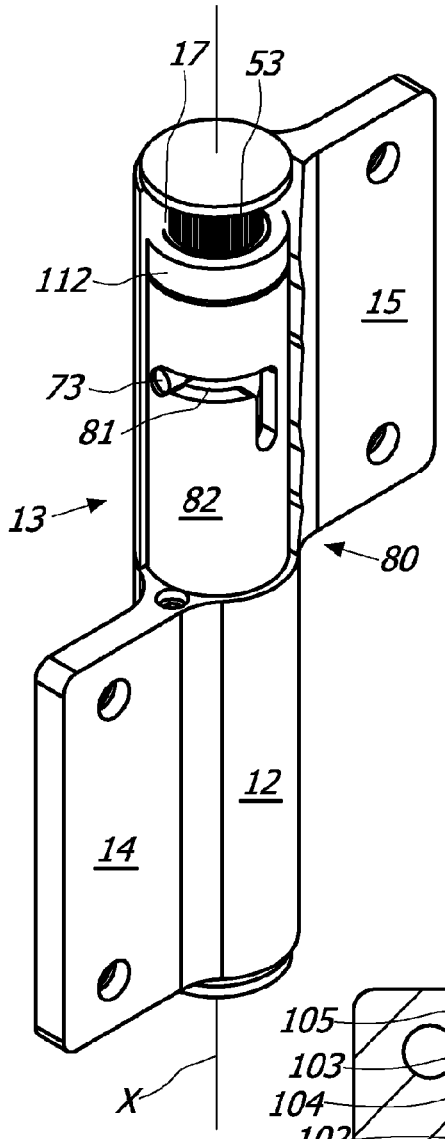
FIGS. 5*a*, 5*b* and 5*c* are respectively axonometric, axially sectioned and side views of the first embodiment of the hinge device 1 of FIG. 1, wherein the second tubular half-shell 13 is in the fully open position with the connecting plate 15 substantially coplanar with the connecting plate 14 of the first fixed tubular half-shell 12.
Figure 5B:
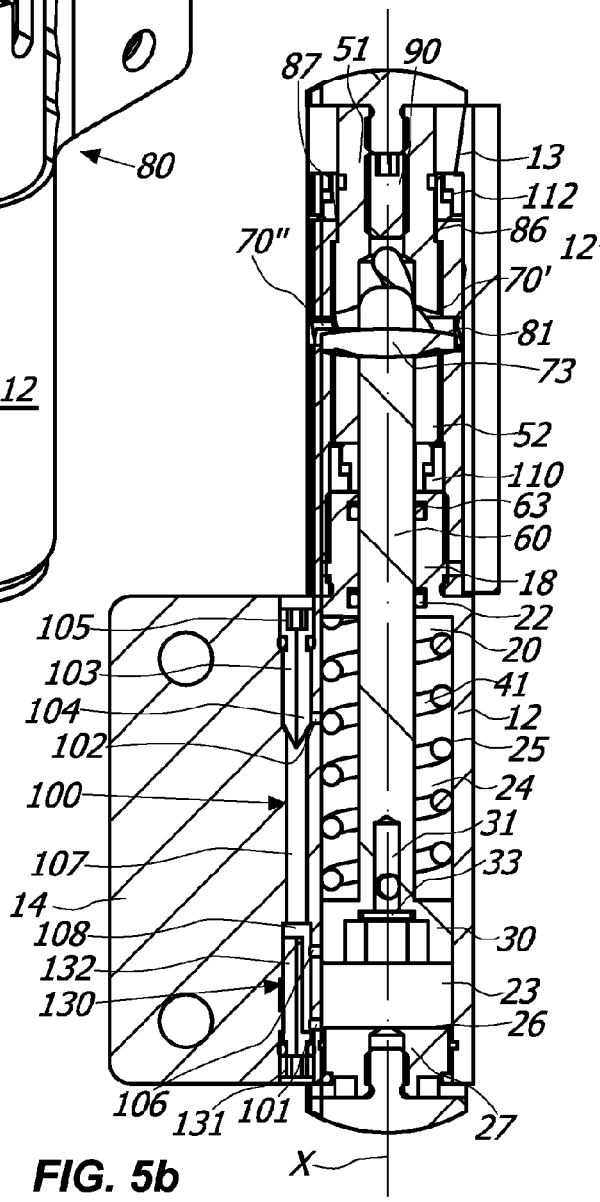
Figure 5C:
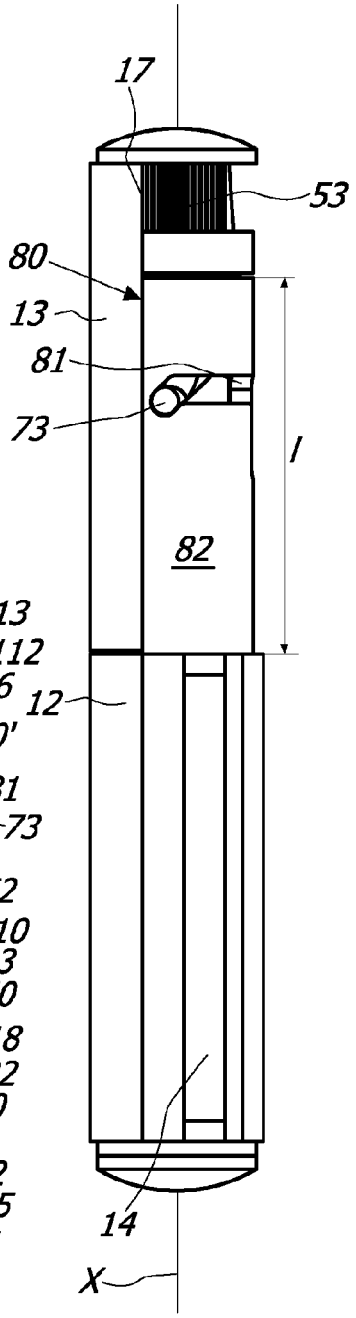
Figure 33A:
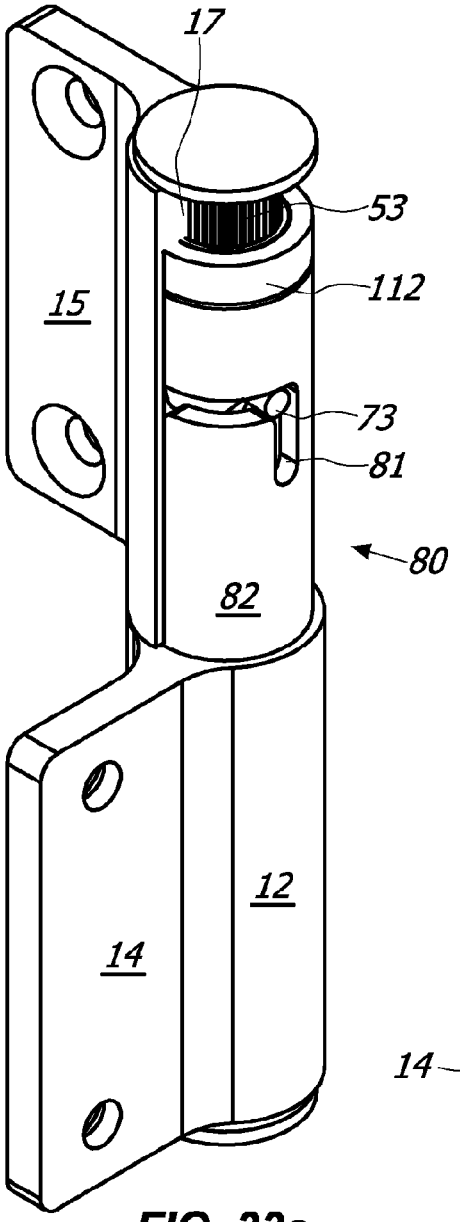
FIGS. 33*a* and 33*b* are respectively axonometric and axially sectioned views of the embodiment of the hinge device 1 of FIG. 30, wherein the second tubular half-shell 13 is in a partially open position with the connecting plate 15 substantially perpendicular to the connecting plate 14 of the first fixed tubular half-shell 12 and wherein the stop screw 90 is in the working position to block the sliding of the elongated element 60.
Figure 33B:
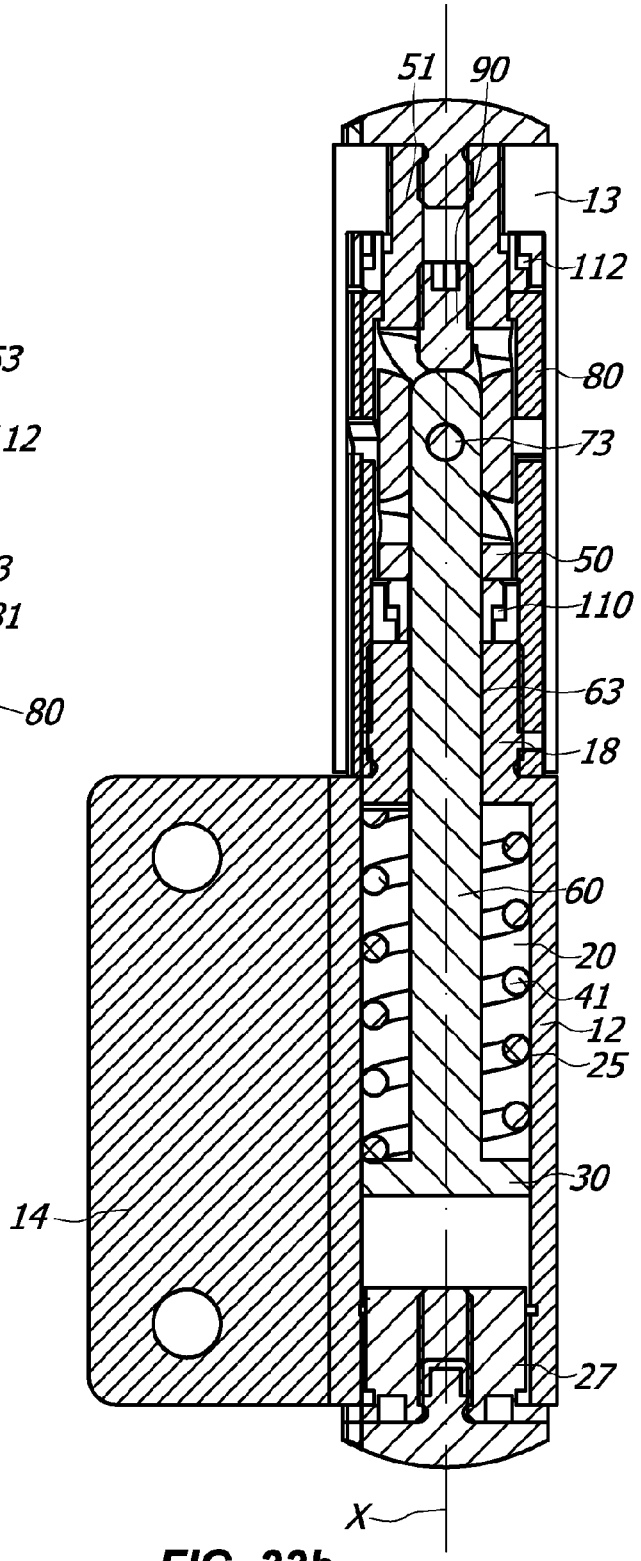
Figure 34A:
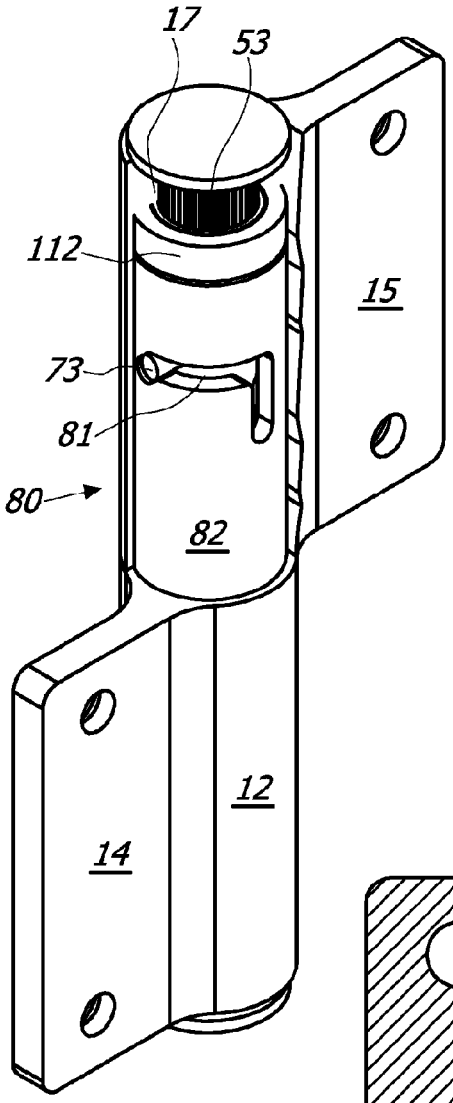
FIGS. 34*a*, 34*b* and 34*c* are respectively axonometric, axially sectioned and side views of the embodiment of the hinge device 1 of FIG. 30, wherein the second tubular half-shell 13 is in the fully open position with the connecting plate 15 substantially coplanar with the connecting plate 14 of the first fixed tubular half-shell 12.
Figure 34B:
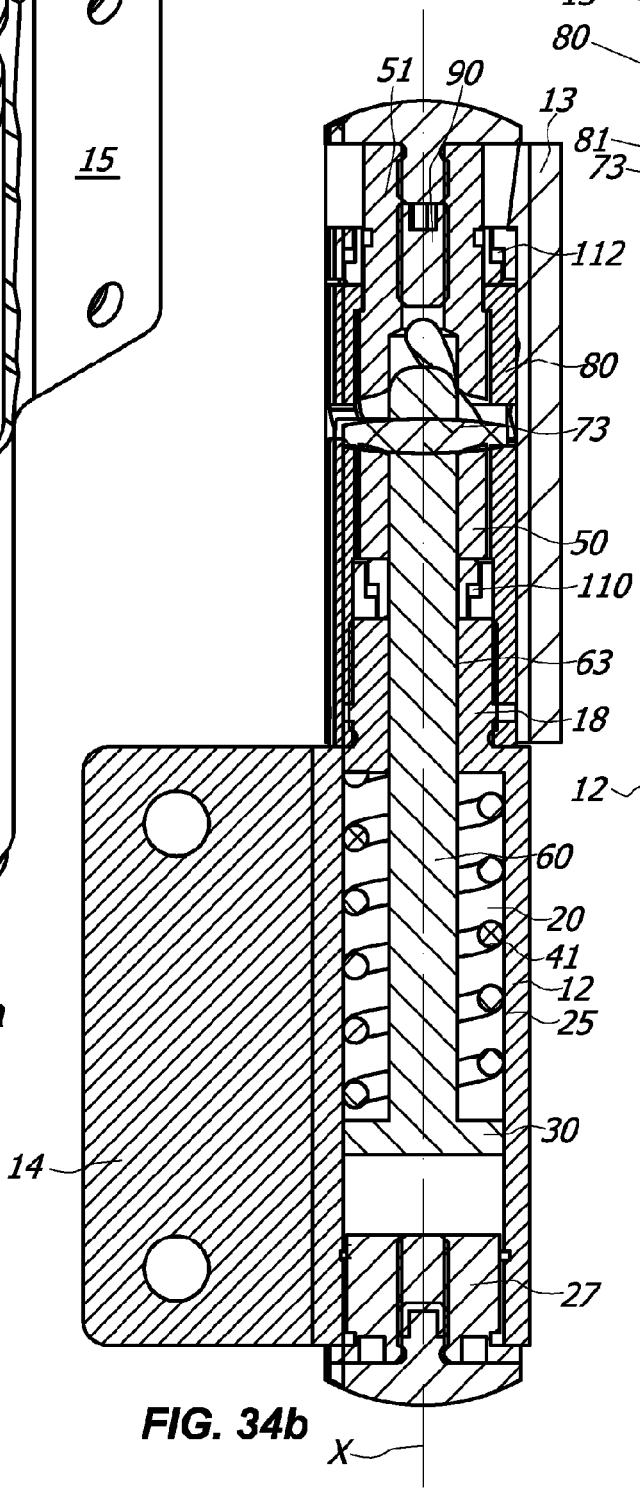
Figure 34C:
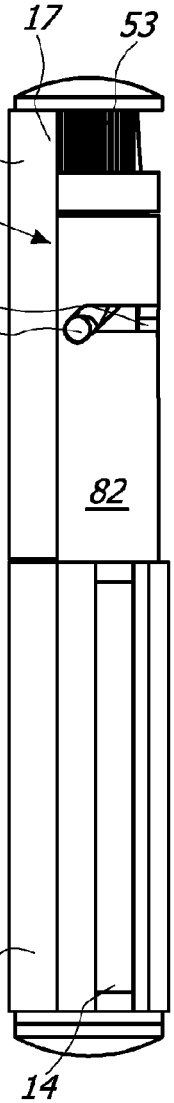
Figure 35:
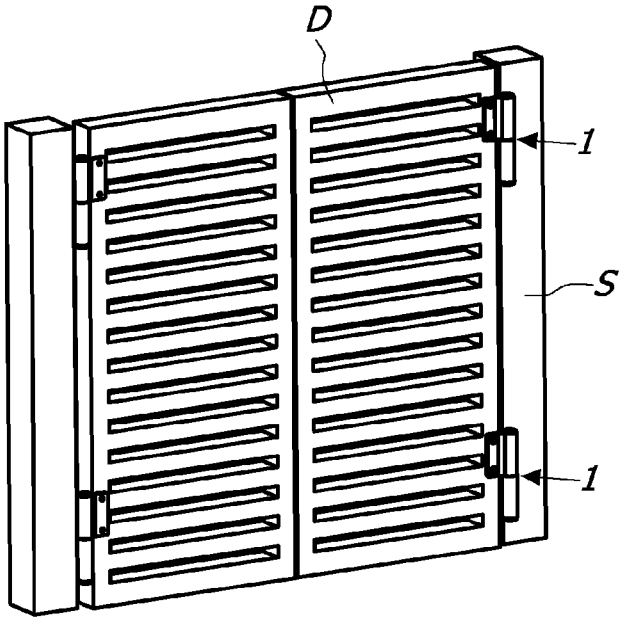
FIG. 35 is an axonometric view of a seventh embodiment of the hinge device 1.
Figure 36:
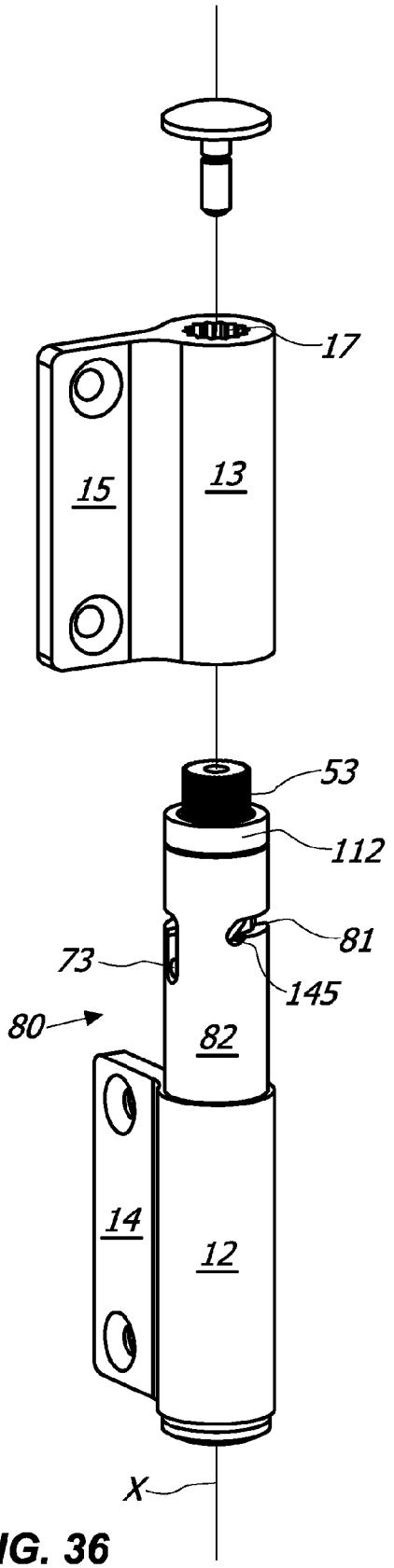
FIG. 36 is a partially exploded axonometric view of the seventh embodiment of the hinge device 1.
Figure 37:
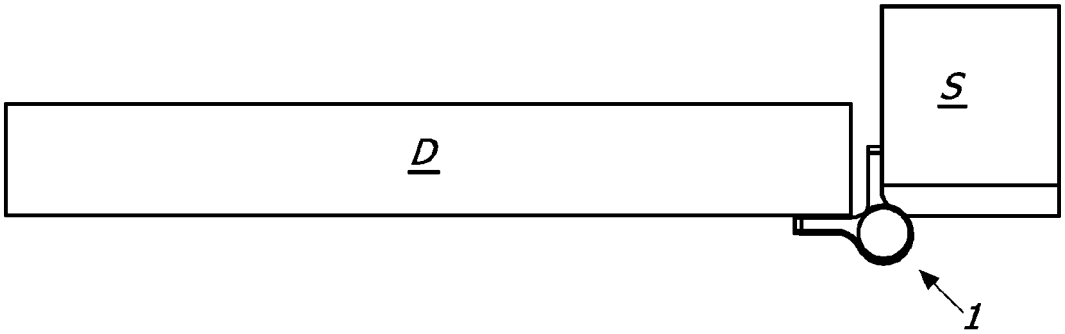
FIG. 37 is a top view of the embodiment of FIG. 35 wherein the hinge device 1 has the second tubular half-shell 13 is in the closed position.

For example, FIGS. 4*b* and 33*b* show embodiments of the hinge device 1 in which the stop screw 90 is in working position to prevent the pin 73 to slide through the second portion 84" of the guide cam slot 81 of the bushing 80. Thanks to this configuration, in such embodiments the pin 73 slides between the closed and fully open position of the second half-shell 13 without any intermediate blocking point, which fully open position in this embodiments shows an angle of approximately 90° between the connecting plates 14, 15.

In some embodiments, such as the ones shown in FIGS. 30 to 34*c*, a pair of stop screws 90, 90' may be provided, which are placed in correspondence of the respective upper and lower ends 2, 3 of the hinge device 1.

The top stop screw 90 may have the above described features.

The lower stop screw 90' may have a first end 91' susceptible to interact selectively with the plunger member 30 and a second end 92' to be operated from the outside by a user.

As mentioned above, some embodiments of the hinge device 1 may include a working fluid, such as those shown in FIGS. 1 to 8*d* and 20 to 29*b*.

Such embodiments may include the elastic means 40, such as those shown in FIGS. 1 to 8*d*, 20 to 21*c* and 26 to 29*c*, or not include them, such as the one shown in FIGS. 22 to 25*c*.

In the embodiments that include the elastic means 40, the latter will ensure automatic closing or the opening of the closing element D, such as in those shown in FIGS. 1 to 8*d*, 20 to 21*c* and 26 to 29*c*, or simply allow the plunger member 30 to return from one of the distal or proximal positions towards the of other one of the distal or proximal positions without ensuring the automatic closing or opening of the closing element D.

In the first case the elastic means 40 may include a thrust spring 41 of relatively high force, in the second case they may include a reset spring having a relatively low force.

In the first case, the hinge device 1 acts as a hydraulic hinge or door closer with automatic closure, while in the second case the same hinge device 1 acts as a hydraulic damping hinge.

It is understood that the use of the spring 41 in the damping hinge device 1 is purely optional. For example, in the embodiment of the hinge device 1 shown in FIGS. 22 to 25*b* the spring is not employed.

This allows using the entire length of the working chamber 20, thus minimizing the bulkiness.

Advantageously, in embodiments that include the working fluid, the working chamber 20 may include one or more sealing elements 22 to prevent the leakage thereof, for example one or more o-rings.

The plunger member 30 may separate the working chamber 20 in at least one first and at least one second variable volume compartment 23, 24 fluidly communicating each other and preferably adjacent. Suitably, when present, the elastic counteracting means can be inserted in the first compartment 23.

To allow the passage of the working fluid between the first and the second compartments 23, 24, the plunger member 30 may comprise a passing-through opening 31 and valve means, which may include a non-return valve 32.

Advantageously, the non-return valve 32 may include a disc 33 inserted with minimum clearance in a suitable housing 34 to move axially along the axis X.

Depending on the direction in which the non-return valve 32 is mounted, it opens upon the opening or closing of the closing element D, so as to allow the passage of the working fluid between the first compartment 23 and second compartment 24 during one of the opening or closing of the closing element D and to prevent backflow thereof during the other of the opening or the closing of the same closing element D.

For the controlled backflow of the working fluid between the first compartment 23 and the second compartment 24 during the other of the opening or closing of the closing element D, a suitable hydraulic circuit 100 may be provided.

Suitably, the plunger member 30 may include, or respectively may consists of, a cylindrical body tightly inserted in the working chamber 20 and facing the inner side wall 25 thereof. The hydraulic circuit 100 may at least partially lie within the first tubular half-shell 12, and may preferably include a channel 107 external to the working chamber 20 which defines an axis X' substantially parallel to the axis X.

Advantageously, the hydraulic circuit 100 may include at least one first opening 101 in the first compartment 23 and at least one further opening 102 in the second compartment 24. Depending on the direction in which is mounted the valve 32, the openings 101, 102 may act respectively as inlet and outlet of the circuit 100 or as outlet and inlet thereof.

The first tubular half-shell 12 may have at least one first adjusting screw 103 having a first end 104 which interacts with the opening 102 of the hydraulic circuit 100 and a second end 105 which can be operated from outside by a user to adjust the flow section of the working fluid through the same opening 102.

In the embodiments shown in FIGS. 1 to 8*d* and 20 to 29*c*, the valve 32 opens upon opening of the closing element and closes upon closing thereof, thus forcing the working fluid to flow back through the hydraulic circuit 100. In these conditions, the opening 101 acts as inlet of the hydraulic circuit 100 while the opening 102 acts as outlet thereof.

Suitably, the outlet 102 may be fluidly decoupled from the plunger member 30 during the whole stroke thereof. The screw 103 may have the first end 104 which interacts with the opening 102 to adjust the closing speed of the closing element.

In some preferred but not exclusive embodiments, for example those shown in FIGS. 1 to 8*d* and 22 to 25*c*, the hydraulic circuit 100 may include a further opening 106 in the second compartment 24, which in the above mentioned example may act as a second outlet in the second compartment 24 for the circuit 100.

Therefore, the plunger member 30 may be in a spatial relationship with the openings 102, 106 such as to remain fluidly decoupled from the opening 102 for the entire stroke of the plunger member 30, as mentioned above, and such as to remain fluidically coupled with the opening 106 for a first part of the stroke thereof and to remain fluidly decoupled from the same opening 106 for a second part of the stroke of the plunger member 30.

In this way, in the above embodiment the closing element D latches towards the closed position when the second tubular half-shell 13 is in close to the first tubular half-shell 12, or in any event when the closing element D is in the proximity of the closed position.

In the case of valve 32 mounted on the contrary, i.e. that opens upon the closing of the closing element and closes upon the opening thereof, the circuit 100 configured as described above allows having two degrees of resistance during opening, a first resistance for a first angular portion of the opening of the closing element D and a second resistance for a second angular portion of the opening thereof.

In this case, upon opening of the closing element D the working fluid flows from the second compartment 24 to the first compartment 23 through the channel 107, by entering through the openings 102, 106 and exiting through the opening 101. Upon the time of closing of the closing element D the working fluid flows from the first compartment 23 to second compartment 24 through the valve 32. The first resistance during opening is obtained when the plunger member 30 is fluidly coupled with the opening 106 during the first part of the stroke thereof, while the second resistance during opening is obtained when the plunger member 30 is fluidly decoupled from the same opening 106 for the second part of the stroke thereof.

In some preferred but not exclusive embodiments, for example those shown in FIGS. 1 to 5*d*, the channel 107 may include a substantially cylindrical seat 108 in which a regulating member 130 can be inserted, the regulating member 130 comprising an operative end 131 and a rod 132 coupled thereto. The rod 132 may define a longitudinal axis X" mutually parallel or coincident with the axis X' of the channel 107.

Figure 8A:
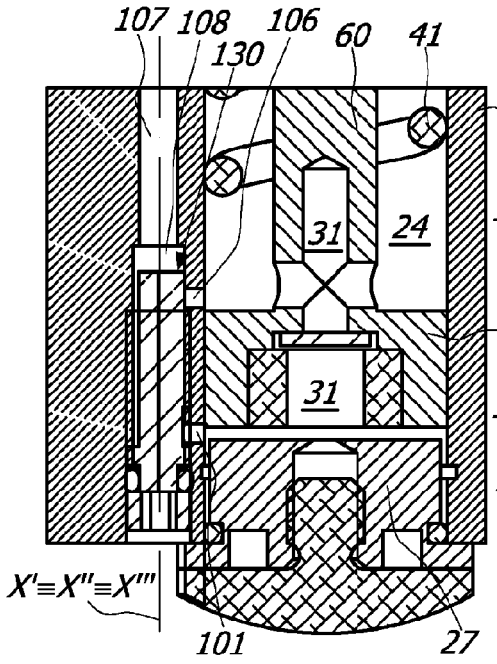
FIGS. 8*a* and 8*c* are enlarged sectioned views of some details of the first embodiment of the hinge device 1 of FIG. 1, with respectively in FIGS. 8*b* and 8*d* an enlargement of a first embodiment of the regulating member 130 respectively in the of work and rest positions.
Figure 8B:
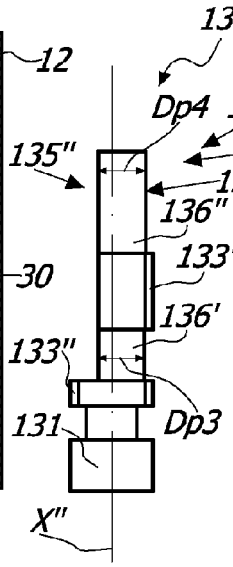
FIG. 8*e* is a sectioned, enlarged and broken view of some details of the first embodiment of the hinge device 1 of FIG. 1, which shows the seat 108 of the channel 100.
FIG. 8*f* is an axonometric view of the regulating member 130 of FIGS. 8*a* and 8*b;*
Figure 8E:
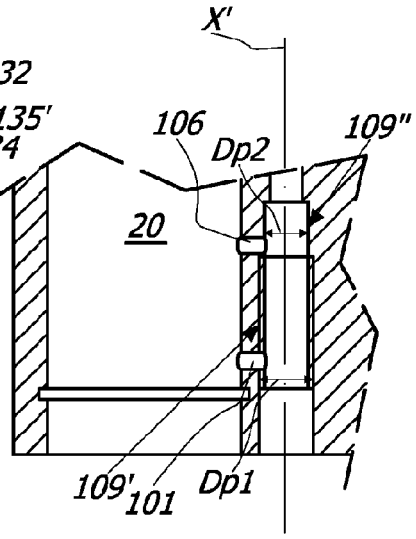

As particularly shown in FIG. 8*e*, the seat 108 may have a first cylindrical portion 109' in correspondence of the opening 102 and a second cylindrical portion 109" in correspondence of the opening 106.

To allow the mutual coupling between the regulating member 130 and the seat 108, the rod 132 of the regulating member 130 may include a first and a second threaded portion 133', 133", while the seat 108 may be counterthreaded in correspondence of the first cylindrical portion 109'. Alternatively, instead of the first threaded portion 133' the regulating member 130 may include a ring of the Seeger type inserted through a first countershaped cylindrical portion 109'.

However, the second cylindrical portion 109" may advantageously be smooth, that is free of counterthread. Therefore, the first cylindrical portion 109' of the seat 108 may have a maximum diameter Dp1 greater than the one Dp2 of the second cylindrical portion 109".

The rod 132 may have an outer surface 134 faced to both the openings 101 and 106, which in a first embodiment shown for example in FIGS. 8*a* to 8*f* may essentially have a substantially cylindrical area 135' and a flat area 135" opposite thereto.

More particularly, the outer surface 134 may include a third and a fourth cylindrical portion 136', 136" and a first and a second flat portion 137', 137" opposed thereto which are respectively faced to the first and the second cylindrical portion 109', 109" of the seat 108.

Suitably, the maximum diameter Dp4 of the fourth cylindrical portion 136" is greater than the maximum diameter Dp3 of the third cylindrical portion 136' and may substantially coincide with the maximum diameter Dp2 of the second cylindrical portion 109" of the seat 108. Therefore, the maximum diameter Dp3 of the third cylindrical portion 136' is less than the maximum diameter Dp1 of the first cylindrical portion 109'.

The shape of the rod 132 may be such that the substantially cylindrical area 135' extends beyond the plane of symmetry of the regulating member 130. Therefore, the first and the second flat portions 137', 137" may have respective maximum widths h', h" lower than the respective maximum diameters Dp3, Dp4 of the third and fourth cylindrical portions 136', 136".

Advantageously, the first threaded portion 133', which may be interposed between the third and fourth cylindrical portions 136', 136", may in turn include a first cylindrical zone 138' in correspondence of the third and fourth cylindrical portions 136', 136" and a first planar zone 138" in correspondence of the first and second flat portions 137', 137".

On the other hand, the second threaded portion 133", which may be interposed between the operative end 131 and the third cylindrical portion 136' of the rod 132, may in turn include a second cylindrical zone 139' in correspondence of the third cylindrical portion 136' and a second planar zone 139" in correspondence of the first flat portion 137'.

Thanks to one or more of the above features, the regulating member 130 easily allows adjusting the flow section of the opening 106 when, as in this case, the limited bulkiness of the hinge device 1 does not allow the use a "classical" radial screw. The regulating member 130 allows for example to adjust the force by which the closing element D latches towards the closed position, as well as to avoid the latch action, as well as to adjust or to avoid one of the degrees of resistance during opening.

Figure 8C:
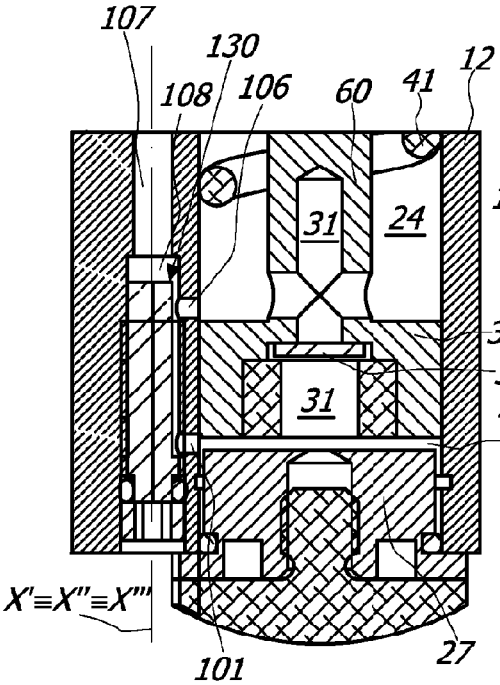
Figure 8D:
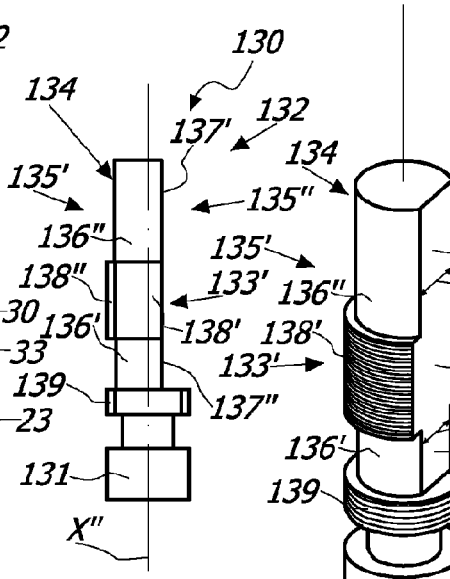
Figure 8F:
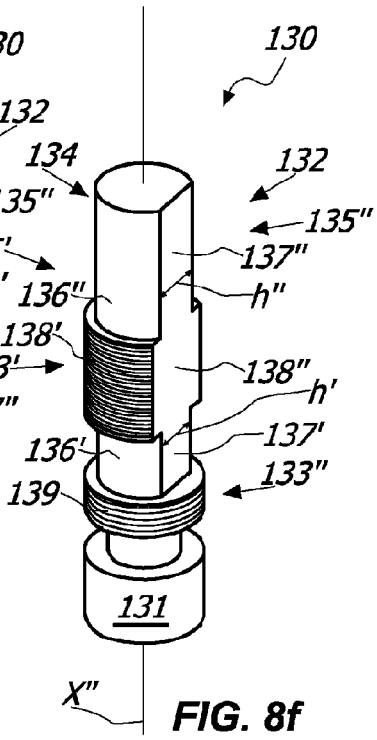

By acting on the operative end 131, for example by using a screwdriver, a user can promote the rotation of the rod 132 around the axis X" between a working position, shown for example in FIGS. 8*b* and 8*d*, and a rest position, shown for example in FIGS. 8*a* and 8*c*.

As shown in these figures, in the working position the third and fourth cylindrical portions 136', 136" are respectively faced to the first and second openings 101, 106, so that the outer surface 134 of the rod 132 selectively obstruct the opening 106 while the other opening 101 will remain in fluid communication with the channel 107 and the opening 102 regardless of the rest or working position of the rod 132.

On the other hand, in the rest position the first and the second flat portions 137', 137" remain respectively faced to the openings 101, 106, so that the working fluid is free to pass between the first and the second volume variable compartments 23, 24 through the channel 107.

It is therefore apparent that regardless the rest or working position of the regulating member 130 the opening 101 is always in fluid communication with the opening 102, while depending from the rest or the working position of the regulating member 130 the opening 106 remains respectively in fluid communication or not with the same opening 102.

Consequently, when the adjustment member 130 is in the rest position the opening 101 remains in fluid communication with both openings 102 and 106, so as to allow for example the above mentioned latch action or double resistance during opening, while in the working position, the opening 101 remains in fluid communication exclusively with the opening 102, so as to exclude for example the above mentioned latch action or double resistance during opening.

Figure 50:
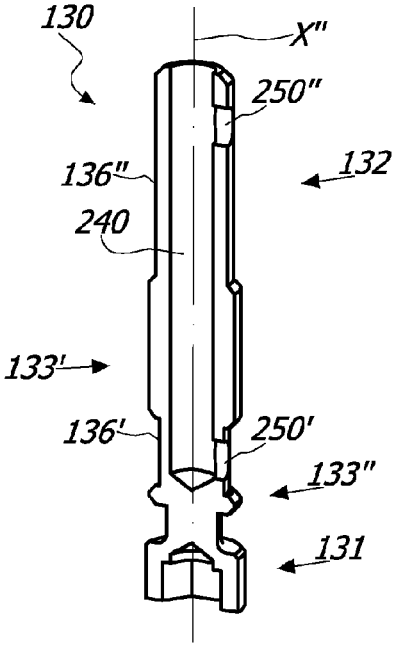
FIG. 50 is an axonometrically sectioned view taken along a plane L-L in FIG. 49.

In an alternative embodiment, shown in FIGS. 48*a* to 50, the regulating member 130 may include an axial blind hole 240, while the third and fourth cylindrical portion 136', 136" may include a respective first and second passing-through hole 250', 250" in mutual fluidic communication with the axial blind hole 240, as particularly shown in FIG. 50.

The operation of this embodiment is similar to that of the above described embodiment shown in FIGS. 8*a* to 8*f*.

Figure 48A:
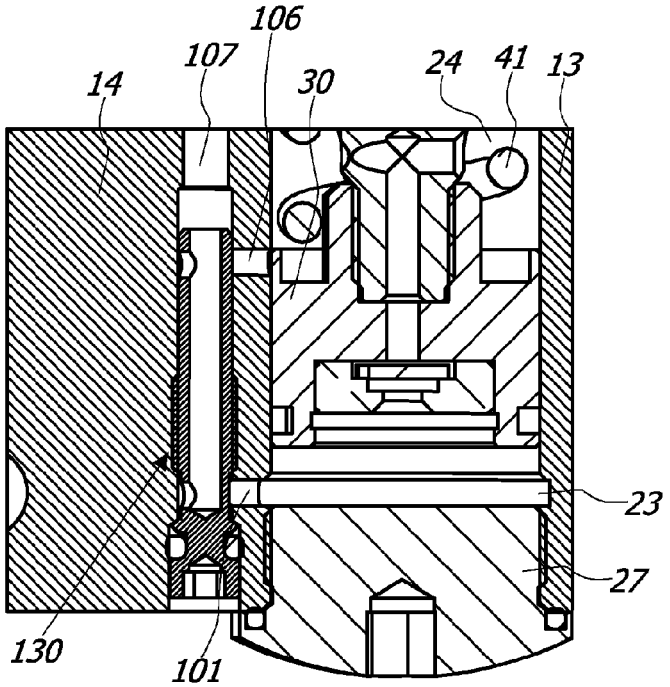
FIGS. 48*a* and 48*b* are enlarged sectioned views of some details of a hinge device 1 that includes a second embodiment of the regulating member 130 respectively in the work and rest positions.
Figure 49:
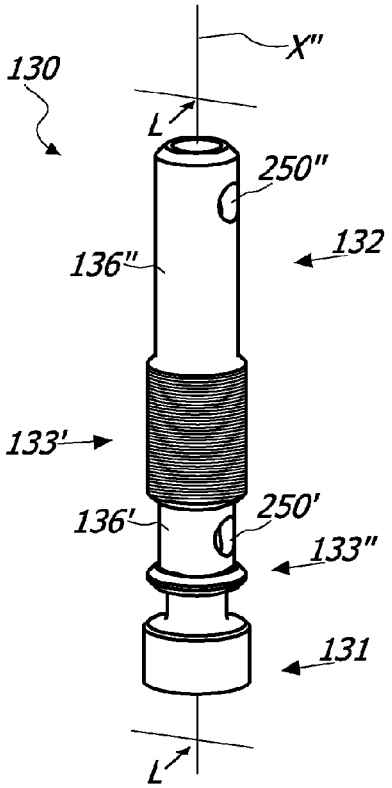
FIG. 49 is an axonometric view of the second embodiment of the regulating member 130 of FIGS. 48*a* and 48*b;*
Figure 48B:
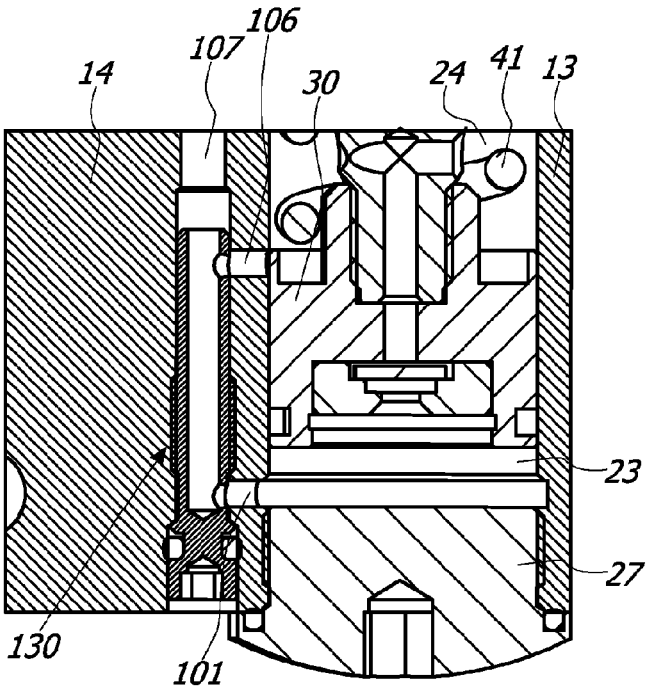

As shown in FIGS. 48*a* and 48*b*, when the rod 132 is in the rest position, as shown in FIG. 48*b*, the second passing-through hole 250" remains fluidly coupled with the opening 106 and when the rod 132 is in working position, as shown in FIG. 48*a*, the second passing-through hole 250" remains fluidly decoupled from the opening 106, so as to selectively obstruct it.

Suitably, the first passing-through hole 250' may be susceptible to put in mutual fluid communication the opening 101 and the opening 102 through the channel 107 regardless of the rest or working position of the rod 132. In fact, when the latter is in the working position, the working fluid flows in correspondence of the cylindrical portion 136' and passes through the passing-through hole 250'.

In some preferred but not exclusive embodiments, for example those shown in FIGS. 1 to 8 and 22 to 29*b*, the channel 107 may pass through the connecting plate 14.

Advantageously, in such embodiments the regulating member 130 can be inserted at one end of the channel 107, for example the bottom one, to selectively obstruct the opening 106, while the adjustment screw 103 can be inserted at the other end of the same channel 107, for example the upper one, to selectively obstruct the opening 102.

More particularly, the regulating member 130 and the adjustment screw 103 can be inserted into the channel 107 so that the axis X' of the latter coincides with the fourth axis X" of the regulating member 130 and with the fifth axis X'" of the adjusting screw 103. It is understood that the axes X', X" and X'" are substantially parallel to the axis X.

Figure 3A:
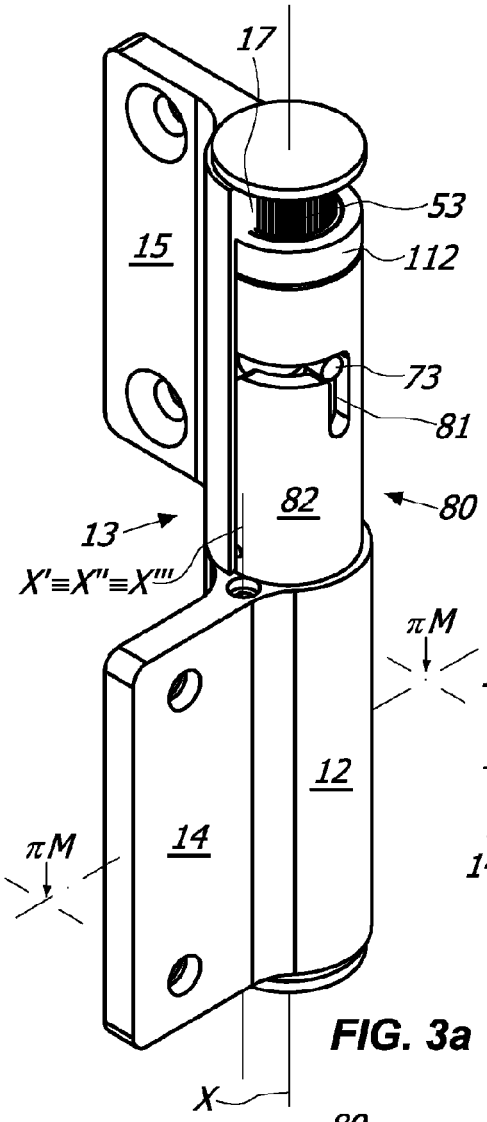
FIGS. 3*a* and 3*b* are respectively axonometric and axially sectioned views of the first embodiment of the hinge device 1 of FIG. 1, wherein the second tubular half-shell 13 is in a partially open position with the connecting plate 15 is substantially perpendicular to the connecting plate 14 of the first fixed tubular half-shell 12 and wherein the stop screw 90 is in the rest position.
Figure 3B:
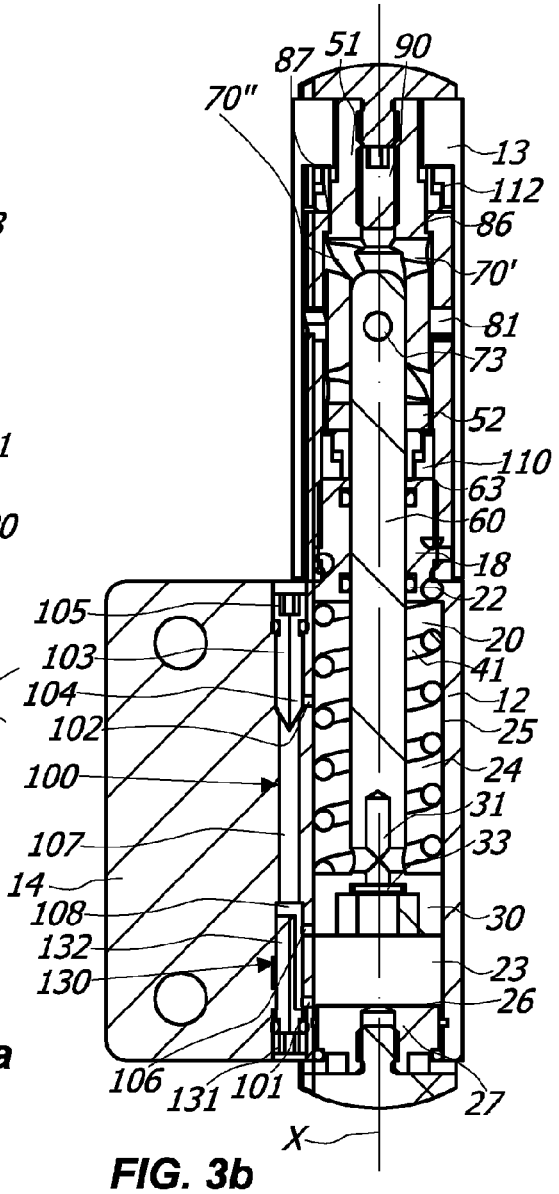
Figure 3C:
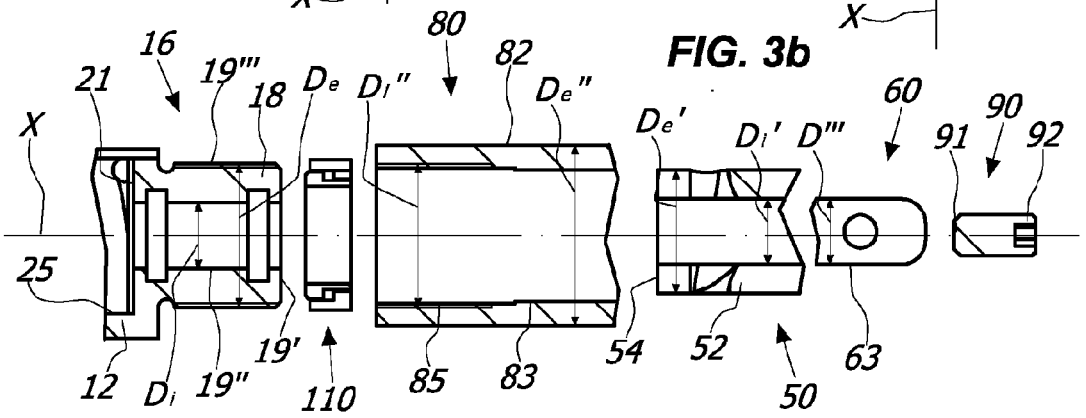
FIG. 3*c* is an axially sectioned exploded view of some details of the first embodiment of the hinge device 1 of FIG. 1.

In this way, the operative end 131 of the regulating member 130 and the operative end 105 of the adjusting screw 103 can be accessible by the user at opposite sides with respect to a median plane πM, shown for example in FIG. 3*a*, passing through the connecting plate 14 and substantially perpendicular to the axes X', X" and X'", and consequently perpendicular to the axis X.

Thanks to this configuration, it is possible to obtain both the adjustment of the closing and/or opening speed of the closing element D (by acting on the adjustment screw 103) and the force of the latch action and/or of the resistances during opening (by acting on the regulating member 130) with minimum bulkiness and round shapes, typical of the "Anuba"-type hinges.

In some preferred but not exclusive embodiments, for example those shown in FIGS. 20 to 21*c* and 43*a* to 44*c*, the closing cap 27 of the working chamber 20 may include a passing-through duct 100' and a substantially annular peripheral groove 29 around the substantially cylindrical side wall 28 of the same cap 27. Once the cap 27 is inserted in the working chamber 20, its substantially cylindrical side wall 28, and therefore the peripheral groove 29, remains faced the inner side wall 25 of the same working chamber 20.

Conveniently, the peripheral groove 29, which may have facing side walls 29', 29" and a bottom wall 29", may be open at the top so that the bottom wall 29'" and the inner side wall 25 of the working chamber 20 remain directly faced each other.

The passing-through duct 100' may include a pair of first branches 140', 140" having respective openings 100 fluidly communicating with the channel 107 through the peripheral groove 29 and the opening 101 passing through the second half-shell 12 and a second branch 141 with an opening 100'" fluidly communicating with the first compartment 23.

A central manifold 100"" may lie in a substantially central position along the X axis between the first branches 140', 140" and the second branch 141, which central manifold 100"" is therefore in fluid communication with both the channel 107 that the first compartment 23.

Advantageously, the cap 27 may include the adjustment screw 103 preferably in axial position along the axis X. The screw 103 may have the end 104 interacting with the central manifold 100"" and the operative end 105 to be operated from the outside by a user to adjust the flow section of the working fluid therethrough.

In the embodiment shown in FIGS. 20 to 21*c* and 43*a* to 44*c*, in which the valve means 32 are configured to allow the passage of the working fluid between the first compartment 23 and second compartment 24 during the opening of the closing element D and to prevent the backflow thereof during the closing of the same closing element D, the single screw 103 is susceptible to adjust the closing speed of the closing element D.

Thanks to one or more of the above features, it is possible to obtain a simple and quick adjustment even in hinge devices 1 having minimum dimensions or completely round shaped, where it is not possible to insert screws neither axially nor radially.

Moreover, the peripheral annular channel 29 allows simplifying the mounting of the hinge device 1, while improving the reliability thereof.

As mentioned above, some embodiments of the hinge device 1 may include the elastic counteracting means 40, such as those shown in FIGS. 1 to 8*d*, 20 to 21*c* and 26 to 34*c*. Such embodiments may include the working fluid, such as those shown in FIGS. 1 to 8*d*, 20 to 21*c* and 26 to 29*c*, or not, such as that shown in FIGS. 30 to 34*c*.

In the latter case, the hinge device 1 acts as a purely mechanical opening/closing hinge.

In some preferred but not exclusive embodiments, for example those shown in FIGS. 1 to 8*d*, 20 to 21*c* and 30 to 34*c*, the spring 41 and the plunger member 30 may be coupled to each other so that the former 41 is in the position of maximum elongation in correspondence of the end-stroke distal position of the latter. In this case, the spring 41 may be interposed between the cylindrical portion 52 of the pivot 50 and the plunger member 30.

In order to minimize the friction between the moving parts, at least one antifriction member may be provided, such as an annular bearing 110, interposed between the pivot 50 and the end portion 16 of the first tubular half-shell 12 for the supporting thereof.

In fact, in the above mentioned embodiment the pin 73 will be pulled downwards, thus urging downwards also the pivot 50 which therefore rotate about the axis X on the bearing 110. Suitably, the pin loads the stresses due to the action of the spring 41 on the latter bearing 110.

In other preferred but not exclusive embodiments, such as the one shown in FIGS. 26 to 29*c*, the spring 41 and the plunger member 30 may be coupled to each other so that the first is in the position of maximum elongation in correspondence of the proximal end-stroke position of the plunger member 30. In this case, the spring 41 may be interposed between the bottom wall 26 of the working chamber 20 and the plunger member 30.

In this case, to minimize the friction between the moving parts at least one antifriction member may be provided, for example a further annular bearing 111, interposed between the pivot 50 and the upper wall 121 of a sleeve 120 susceptible to retain the pivot 50, which sleeve 120 being unitary coupled externally to the bushing 80 coaxially therewith.

In fact, with the above configuration the pin 73 is urged upwards, by urging in turn upwards the pivot 50 which therefore rotate about the axis X on the bearing 111. The retaining sleeve 120 may for example be screwed into the lower portion of the bushing 80, so as to retain the pivot 50 in the operative position.

In any case, the hinge device 1 can be configured to minimize friction between the moving parts.

For this purpose, at least one antifriction member may be provided, for example a further annular bearing 112, interposed between the bushing 80 and the second tubular half-shell 13, in such a manner that the latter rotates around the axis X on the bearing 112.

Therefore, the bushing 80 may suitably have a central opening 86 in the proximity of the upper portion 87 for insertion of the end portion 51 of the pivot 50. More particularly, the bushing 80 and the pivot 50 may be mutually configured so that once the pivot 50 is inserted within the bushing 80 the end portion 51 of the former passes through the central opening 86 of the latter.

To this end, the bushing 80 may have a height h substantially equal to the sum of the height of the bearing 110, the tubular body 52 of the pivot 50 and its coupling portion 85 with the outer side wall 19''' of the annular appendix 18.

Therefore, the bearing 112 rests on the upper portion 87, so that the closing element does not load at all the pivot 50 during its rotation about the axis X. In fact, the weight of the closing element D is loaded on the bearing 112.

Moreover, the position of the pivot 50 within the bushing 80 prevents misalignment and/or slipping out of the same pivot 50 due to forces pushing the same upwards, for example in the case of a user that force in closing the closing element D. In fact, in this case the pivot 50 impacts against the upper portion 87 of the bushing 80, such as clearly visible in FIGS. 32*b* and 33*b*, thus remaining in its original position.

Moreover, the bushing 80 and the second tubular half-shell 13 may be preferably in a spatial relationship to each other such that the second tubular half-shell 13 once coupled with the bushing 80 remains spaced from the first tubular half-shell 12, for example by a distance d of few tenths of a millimeter.

From the above description, it is apparent that the invention fulfils the intended objects.

The invention is susceptible to many changes and variants. All particulars may be replaced by other technically equivalent elements, and the materials may be different according to the needs, without exceeding the scope of the invention defined by the appended claims.

The invention claimed is:

1. A hinge device configured to rotatably move or check during closing or opening a closing element anchored to a stationary support structure, the hinge device comprising:

a fixed element anchored to the stationary support structure;

a movable element anchored to the closing element, said movable element and said fixed element being mutually coupled to rotate about a first longitudinal axis between an open position and a closed position; and a slider movable along a second axis between a first end-stroke position, corresponding to one of said open and closed positions, and a second end-stroke position, corresponding to the other of said open and closed positions, wherein one of said fixed element or movable element comprises a working chamber defining said second axis for slidably housing said slider, the other one of said fixed element or movable element comprising a pivot defining said first axis, said pivot and said slider being mutually coupled so that a rotation of the movable element around said first axis corresponds to a at least partly sliding of the slider along said second axis and vice-versa, wherein said working chamber includes a working fluid acting on said slider to hydraulically counteract an action thereof, said slider including a plunger member configured to separate said working chamber in a first and a second variable volume compartment fluidly communicating with each other, said plunger member comprising a pass-through opening to put in fluid communication said first compartment and said second variable volume compartments and a valve member interacting with said opening to allow a passage of the working fluid between said first compartment and said second compartment during one of the opening or closing of the closing element and to prevent a backflow thereof during the other of the opening or closing of the closing element, a hydraulic circuit being provided to allow the passage of the working fluid between said first compartment and said second compartment during the other of the opening or closing of the closing element, wherein said hydraulic circuit includes a channel external to said working chamber defining a third axis substantially parallel to said first or said second axis, said channel having a first opening in said first compartment and a second opening in said second compartment which is proximal to said first opening, said channel further including a third opening in said second compartment distal from said first opening, wherein said plunger member is in a spatial relationship with said second and third openings of said circuit such to remain fluidly decoupled from said third opening for an entire stroke of the plunger member and such to remain fluidly coupled with said second opening for a first part of said stroke and to remain fluidly decoupled therefrom for a second part of said stroke, wherein a first regulating member for regulating a flow of said working fluid between said first compartment and said second compartment is further provided, said first regulating member including a rod defining a fourth longitudinal axis having an outer surface facing both said first and said second openings, said first regulating member being inserted in said channel to cause said third and fourth axis to be substantially parallel to or coinciding with each other, wherein an outer surface of said first regulating member includes a first portion facing said first opening and a second portion facing said second opening, said first regulating member further including an operative end to be operated from outside by a user to promote the rotation of said rod about said fourth axis between a working position, in which said second portion of the outer surface of the first regulating member selectively obstructs said second opening, and a rest position, in which the latter and said channel are in mutual fluid communication, said first portion of the outer surface of said first regulating member being configured or dimensioned such that said first opening and said third opening are always in mutual fluid communication through said channel regardless of whether the rod is in the rest position or in the working position, and wherein said channel includes a seat for said first regulating member that includes said first and said second openings, said seat having a first portion at said first opening having a first maximum diameter and a second portion at said second opening having a second maximum diameter, said first and second portions of the outer surface of said first regulating member including a respective third and fourth portion each having a respective maximum diameter laying respectively in said first and second portion of said seat.

2. The hinge device according to claim 1, wherein said seat is cylindrical, said first and second portions of said seat are cylindrical, and said third and fourth portions of said regulating member are cylindrical.

3. The hinge device according to claim 1, wherein said fourth cylindrical portion has a maximum diameter substantially coinciding with a maximum diameter of said second cylindrical portion of said seat, said third cylindrical portion having a maximum diameter lower than a maximum diameter of the first cylindrical portion of said seat.

4. The hinge device according to claim 3, wherein said first and said second portions of the outer surface of said first regulating member have a respective first and second flat portions respectively opposite to said third and fourth portion such that, when said rod is in said rest position, said first and said second flat portions remain respectively faced to said first and said second openings, and when said rod is in said working position, said third and fourth cylindrical portions remain respectively faced to said first and said second openings so as to selectively obstruct the latter.

5. The hinge device according to claim 4, wherein said first and second flat portions have respective maximum widths lower than the respective maximum diameters of said third and fourth cylindrical portions.

6. The hinge device according to claim 1, wherein said regulating member includes an axial blind hole, said third and fourth cylindrical portions of said regulating member including a respective first and second pass-through hole in mutual fluid communication with said axial blind hole so that, when said rod is in said rest position, said second pass-through hole remains fluidly coupled with said second opening, and when said rod is in said working position, said second pass-through hole remains fluidly decoupled from said second opening so as to selectively obstruct said second opening, said first pass-through hole being configured to put in mutual fluid communication said first opening and said third opening through said channel regardless of whether the rod is in the rest position or in the working position.

7. The hinge device according to claim 1, wherein said first regulating member includes a first threaded portion interposed between said third and said fourth portions, said first portion being counterthreaded, said second portion having an unthreaded outer surface.

8. The hinge device according to claim 7, wherein said first threaded portion includes a cylindrical zone in correspondence of the third and fourth cylindrical portion and a flat zone in correspondence of the first and second flat portions of the outer surface of said first regulating member.

9. The hinge device according to claim 1, wherein said valve member is configured to allow the passage of the working fluid between said first compartment and said second compartment during opening of the closing element and to prevent backflow thereof during closing thereof, said channel allowing the passage of the working fluid between said first compartment and said second compartment during closing of the closing element, said plunger member being configured to impart a latch action to the closing element when said movable element is in proximity of the closed position.

10. The hinge device according to claim 1, wherein said valve member is configured to allow the passage of the working fluid between said first compartment and said second compartment during closing or during opening of the closing element and to prevent the backflow thereof during opening or during closing of the closing element, said channel allowing the passage of the working fluid between said first compartment and said second compartment during opening or during closing of the closing element, said plunger member being in a spatial relationship with said second and third openings of said channel such that the closing element has a first resistance during closing or during opening for a first part of an angular rotation of the movable element around said first axis corresponding to said first part of said stroke of said plunger member and a second resistance during closing or during opening for a second part of the angular rotation of the movable element around said first axis corresponding to the second part of said stroke.

11. The hinge device according to claim 1, wherein said working chamber further includes an elastic counteracting member located in said second compartment acting on said slider for returning said slider from one of said first and second end-stroke positions toward the other of said first and second end-stroke positions, said elastic counteracting member being movable between positions of maximum and of minimum elongation.

12. The hinge device according to claim 1, wherein said fixed element comprises a first lower tubular half-shell which includes said working chamber, said movable element comprising a second upper tubular half-shell, the latter being mutually superimposed to said first tubular lower half-shell to rotate about said first longitudinal axis between an open position and a closed position, said pivot being external to said working chamber and coaxially coupled to said second upper tubular half-shell to rotate unitarily therewith between said open and closed positions, said pivot including a tubular body, said plunger member being operatively connected to said pivot and inserted into said working chamber to slide along said first axis between an end-stroke position proximal to said pivot, corresponding to one of the first and the second end-stroke positions of the slider, and a end-stroke position distal therefrom, corresponding to the other one of the first and the second end-stroke positions of the slider.

13. The hinge device according to claim 12, wherein said slider includes a cylindrical element elongated along said longitudinal axis having a first end portion inserted into said working chamber mutually connected with said plunger member and a second end portion external to the working chamber sliding within the tubular body of said pivot, a tubular bushing having a pair of guide cam slots angularly spaced by 180° being provided, said tubular bushing being coaxially laying externally to said tubular body of said pivot, the latter including a pair of grooves equal to each other angularly spaced by 180° each comprising a helical portion wound around said axis, said grooves being communicating with each other to define a pass-through actuating member.

14. The hinge device according to claim 13, wherein said second end portion of said cylindrical elongated element includes a pin inserted in said pass-through actuating member and in said guide cam slots to slide therethrough, so as to reciprocally engage said pivot, said elongated cylindrical element and said bushing, said first lower tubular half-shell including an upper end portion for rotatably supporting said pivot, said bushing and said first lower tubular half-shell being unitarily coupled to each other to allow said guide cam slots to guide a movement of said pin actuated by said pass-through actuating member, said second upper tubular half-shell and said bushing being coaxially coupled to each other so that the latter defines a rotation axis of the former.

15. The hinge device according to claim 14, wherein said bushing and said second tubular half-shell are mutually coupled in a removable manner by mutual sliding along said longitudinal axis.

* * * * *